US008672713B2

(12) United States Patent
Tajiri et al.

(10) Patent No.: US 8,672,713 B2
(45) Date of Patent: Mar. 18, 2014

(54) CONNECTOR TO BE ELECTRICALLY CONNECTED TO CONNECTING TARGET AND TO SUBSTRATE

(75) Inventors: Hiroshi Tajiri, Tokyo (JP); Yasuyuki Miki, Tokyo (JP); Mitsuru Kobayashi, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 169 days.

(21) Appl. No.: 13/418,713

(22) Filed: Mar. 13, 2012

(65) Prior Publication Data

US 2012/0252275 A1 Oct. 4, 2012

(30) Foreign Application Priority Data

Apr. 4, 2011 (JP) ..... 2011-083049

(51) Int. Cl.
*H01R 24/00* (2011.01)

(52) U.S. Cl.
USPC ..... 439/630

(58) Field of Classification Search
USPC ..... 439/630, 637–638, 862, 947, 82–83, 439/342, 587, 59–61
See application file for complete search history.

(56) References Cited

U.S. PATENT DOCUMENTS

| | | | | |
|---|---|---|---|---|
| 3,631,381 | A * | 12/1971 | Pittman | 439/637 |
| 4,275,944 | A * | 6/1981 | Sochor | 439/267 |
| 5,634,819 | A * | 6/1997 | Pan et al. | 439/637 |
| 6,254,435 | B1 * | 7/2001 | Cheong et al. | 439/637 |
| 6,634,911 | B1 * | 10/2003 | Billman et al. | 439/884 |
| 7,637,783 | B2 | 12/2009 | Sasaoka et al. | |

FOREIGN PATENT DOCUMENTS

| | | |
|---|---|---|
| JP | 11-233183 | 8/1999 |
| JP | 2009-199766 | 9/2009 |

* cited by examiner

*Primary Examiner* — Jean F Duverne
(74) *Attorney, Agent, or Firm* — IPUSA, PLLC

(57) ABSTRACT

A connector to be electrically connected to a connecting target including plural electrical objects and to a substrate provided with plural concave portions, includes plural contacts, each including a first terminal configured to extend in a first direction to be connected with the object of the connecting target and include a first contact portion and a second contact portion, a second terminal configured to extend in a second direction opposite to the first direction to be fitted in the concave portion of the substrate, and a base portion configured to be provided with a support portion that separately supports the first contact portion and the second contact portion of the first terminal at different positions and separately support the second terminal from the first terminal.

15 Claims, 22 Drawing Sheets

CONNECTOR TO BE ELECTRICALLY CONNECTED TO CONNECTING TARGET AND TO SUBSTRATE

BACKGROUND OF THE INVENTION

1. Field of the Invention

The present invention relates to a connector and more specifically, to a connector used for electrically connecting a home, an office or an industrial electronic device and a substrate or substrates in an electronic device.

2. Description of the Related Art

Patent Document 1, for example, discloses a connector including a power source, a signal line, a ground line, a shield line or the like for connecting a substrate and an electronic device or substrates in an electronic device.

In Patent Document 1, it is disclosed a connector for which a circuit substrate in a form of a card edge connector such as a Dual Inline Memory Module (DIMM) or the like composed of plural Dynamic Random Access Memory (DRAM) mounted on a print substrate, is a connecting target.

For the card edge connector, plural pads are aligned on its surfaces with equal intervals in an alignment direction which is perpendicular to an inserting direction through which the card edge connector is inserted. The connector includes plural terminals each including a first contact portion and a second contact portion aligned to correspond to the pads of the card edge connector such that the first contact portion and the second contact portion of each of the terminals push the respective pad when being connected with the card edge connector.

For the connector, the terminal is configured such that the first contact portion touches the respective pad before the second contact portion touches the pad when the card edge connector is inserted into the connector to wipe the surface of the pad with the first contact portion. By this operation, dirt, dust, oxide layers, rust or the like on the surface of the pad can be removed by the first contact portion. Therefore, the electrical contact between the second contact portion and the pad can be ensured.

When inserting the card edge connector into the connector and the first contact portion pushes the pad, a reaction force is generated from the pad toward the first contact portion.

However, in Patent Document 1, as the first contact portion and the second contact portion are formed by peaks of an elongating member composing the terminal formed in a waveform, the force applied to the first contact portion is transmitted to the second contact portion to cause a change in pushing force of the second contact portion toward the pad.

In order to stabilize the pushing force of the second contact portion toward the pad to a predetermined value, a bottom portion between the first contact portion and the second contact portion which is protruding in a direction opposite to the first contact portion and the second contact portion is provided. The bottom portion is positioned to touch a wall of a housing of the connector when the card edge connector is inserted into the connector for retaining the pushing force of the first contact portion and the second contact portion toward the pad.

In this technique, the connector is designed such that a force generated by the reaction force from the pad is compensated by a force generated from the bottom portion which is touched to the wall of the housing to maintain the pushing force of the second contact portion toward the pad to be a predetermined value, when the card edge connector is inserted into the connector.

However, the reaction force from the pad or the force generated from the first contact portion may change to alter the pushing force of the second contact portion. It means that the pushing force of the second contact portion toward the pad depends on the force generated between the first contact portion and the pad.

Therefore, it may become difficult to maintain the pushing force of the second contact portion toward the pad to the predetermined value and so that it is required to improve the reliability in an electrical connection of the connector.

Further, in Patent Document 1, the terminals of the connector are intended to be connected to a substrate of an electronic device, to which the card edge connector is to be electrically connected, with only a surface mount technology (SMT) by solder.

However, recently, connectors which connect an electronic device and a substrate or substrates by a press-fit technology without using solder have been developed and required.

Patent Document

[Patent Document 1] Japanese Laid-open Patent Publication No. H11-233183

SUMMARY OF THE INVENTION

The present invention is made in light of the above problems, and provides a connector capable of improving the reliability in an electrical connection and being connected to a substrate by press-fit.

According to an embodiment, there is provided a connector to be electrically connected to a connecting target including plural electrical objects to be contacted and to a substrate provided with plural concave portions, including, a housing and plural contacts which are held by the housing and respectively correspond to the plural objects of the connecting target and the plural concave portions of the substrate, each of the contacts including a first terminal configured to extend in a first direction to be connected with the object of the connecting target, and include a first contact portion provided with a first contact surface to contact the object, a second contact portion provided with a second contact surface to contact the object, a second terminal configured to extend in a second direction opposite to the first direction to be fitted in the concave portion of the substrate, and a base portion configured to be provided with a support portion that separately supports the first contact portion and the second contact portion of the first terminal at different positions such that the first contact surface and the second contact surface are positioned in the same plane, and separately support the second terminal from the first terminal.

BRIEF DESCRIPTION OF THE DRAWINGS

Other objects, features and advantages of the present invention will become more apparent from the following detailed description when read in conjunction with the accompanying drawings.

FIG. 20D is a side view, of the connector of the second embodiment;

DETAILED DESCRIPTION OF THE PREFERRED EMBODIMENTS

Figure 1C:
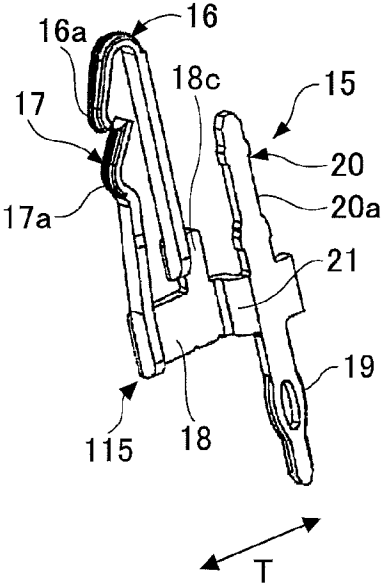
FIG. 1C is an enlarged perspective view of a second kind of contact of the first embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

First Embodiment

Figure 1B:
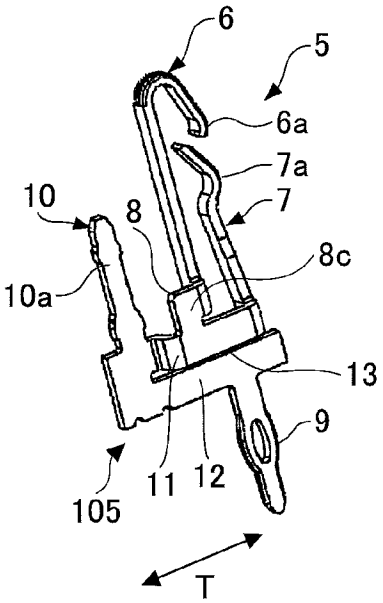
FIG. 1B is an enlarged perspective view of a first kind of contact of the first embodiment.
Figure 1A:
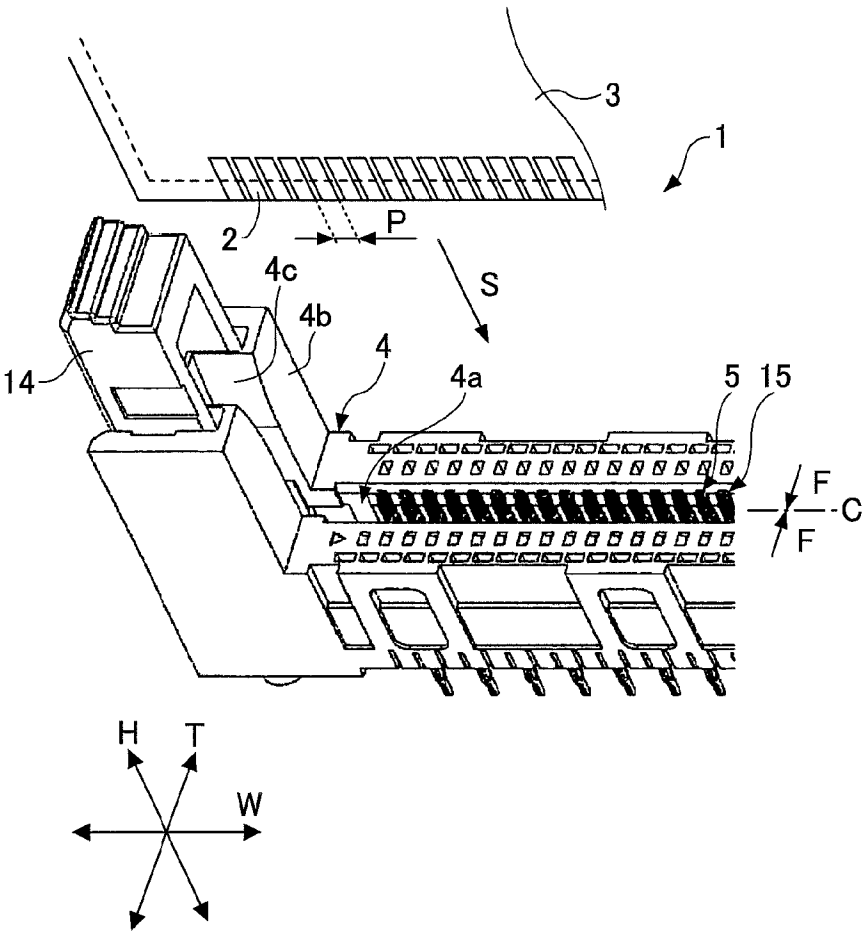
FIG. 1A is a perspective view showing a connector of a first embodiment and a card edge connector.

FIG. 1A is a perspective view showing a connector 1 of a first embodiment and a card edge connector 3 (connecting target).

In this embodiment, the connector 1 is intended to electrically connect the card edge connector 3 and a substrate 30 (not shown in FIG. 1A, see FIG. 13) provided with plural through holes TH (concave portions).

The connector 1 includes a housing 4 provided with an opening portion 4*a*, plural first kind of contacts 5, and plural second kind of contacts 15.

In this embodiment, the card edge connector 3 includes plural pads 2 (objects to be connected) aligned in a width direction "W" of the housing 4 of the connector 1. In this embodiment, the plural pads 2 are aligned on both surfaces of the card edge connector 3 with a predetermined pitch "P".

For the connector 1, the first kind of contacts 5 and the second kind of contacts 15 are held by the housing 4. The first kind of contacts 5 and the second kind of contacts 15 are alternatively aligned in the width direction "W" (alignment direction) exposed in the side walls of the housing 4 facing each other in the opening portion 4*a* to correspond to the pads 2 of the card edge connector 3. This means that the first kind of contacts 5 and the second kind of contacts 15 are also aligned with the predetermined pitch "P".

In this embodiment, as will be explained later in detail, the first kind of contacts 5 and the second kind of contacts 15 are aligned such that each of the first kind of contacts 5 faces the respective second kind of contacts 15.

The card edge connector 3 is detachably connected to the connector 1 by being inserted into the opening portion 4*a* of the housing 4 in an inserting direction "S". When the card edge connector 3 is pulled toward a direction opposite to the inserting direction "S", the card edge connector 3 can be detached from the connector 1. In this embodiment, the inserting direction "S" and its opposite direction are referred to as a height direction "H" of the housing 4 or simply as a height direction "H" as well, hereinafter.

Figure 7A:
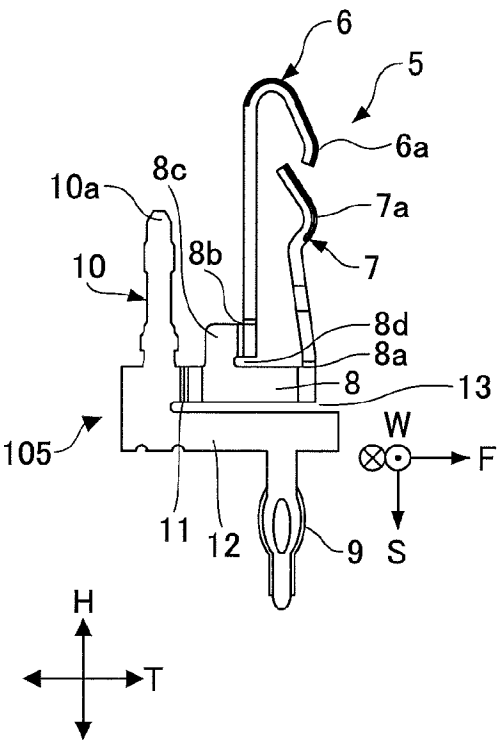
FIG. 7A is a side view of the first kind of contact of the first embodiment.

FIG. 1B is an enlarged perspective view of the first kind of contact 5. FIG. 7A is a side view of the first kind of contact 5.

As shown in FIG. 1B and FIG. 7A, the first kind of contact 5 includes a base portion 105, a first terminal composed of a first contact portion 6 and a second contact portion 7, a second terminal 9 and a fixing portion 10. The first terminal (the first contact portion 6 and the second contact portion 7) is intended to be connected with the respective pad 2 of the card edge connector 3 and the second terminal 9 is intended to be fitted in the through hole TH of the substrate 30 (see FIG. 13). As shown in FIG. 1A, the card edge connector 3 is connected to the connector 1 from the upper side of the housing 4 while the substrate 30 is connected to the connector 1 at the lower side of the housing 4. Therefore, in this embodiment, the first contact portion 6 and the second contact portion 7 composing the first terminal is configured to extend in the upper direction (first direction) and the second terminal 9 is configured to extend in the lower direction (second direction).

The first kind of contact 5 is aligned in the housing 4 such that the base portion 105 extends in a thickness direction "T" (third direction) of the housing 4.

In this embodiment, the width direction "W", the height direction "H", and the thickness direction "T" are substantially perpendicular to each other.

The base portion 105 is provided with a support portion 8, a connecting portion 12, a bending portion 11 and a slit portion 13. The connecting portion 12 and the support portion 8 are formed by splitting the upper part and the lower part of the base portion 105 from a first end (right end in FIG. 7A) of the base portion 105 by the slit portion 13.

The support portion 8 separately supports the first contact portion 6 and the second contact portion 7 at different positions in the thickness direction "T".

Concretely, the second contact portion 7 is formed at a first end 8*a* (right end in FIG. 7A) of the support portion 8 to extend upward in the height direction "H".

Further, in this embodiment, the support portion 8 is provided with a branch portion 8*c* formed at its second end side opposite to the first end 8*a* that is branched upward from the support portion 8. Therefore, the support portion 8 is formed to have a shape like an "L" where the vertical line is shorter than the lateral line.

The first contact portion 6 is formed at an end 8*b* of the branch portion 8*c* to extend upward in the height direction "H". Further, the branch portion 8*c* and the first contact portion 6 are provided to form a short slit 8*d* between the extending portion of the support portion 8 and the first contact portion 6.

The slit portion 13 is formed to extend the area below the connecting ends (the first end 8*a* and the end 8*b*), connected to the support portion 8, of the first contact portion 6 and the second contact portion 7.

As will be explained later in detail, the card edge connector 3 is inserted from the first end 8*a* side of the support portion 8. Therefore, the first contact portion 6 and the second contact portion 7 are formed to have a first contact surface 6*a* and a second contact surface 7*a* protruding toward the first end 8*a* side of the support portion 8 to face the first end 8*a* side, respectively. The support portion 8 supports the first contact portion 6 and the second contact portion 7 such that the first contact surface 6*a* and the second contact surface 7*a* are positioned in the same plane facing the first end 8*a* side. In this embodiment, the support portion 8 supports the first contact portion 6 and the second contact portion 7 such that the first contact surface 6*a* and the second contact surface 7*a* are positioned in the same line but at different positions in the height direction "H". Concretely, the first contact surface 6*a* is formed to be positioned higher than (above) the second contact surface 7*a*.

With this structure, the first contact surface 6*a* of the first contact portion 6 and the second contact surface 7*a* of the second contact portion 7 respectively contact and push the respective pad 2 of the card edge connector 3 toward the first end 8*a* side of the support portion 8 in the thickness direction "T". This direction will be referred to as a pushing direction "F" (fourth direction) hereinafter. In other words, in this embodiment, the pushing direction "F" and its opposite direction are referred to as the thickness direction "T" as well. The structure of the first contact portion 6 and the second contact portion 7 will be explained later.

The fixing portion 10 is formed at a second end (left end in FIG. 7A) opposite to the first end of the base portion 105 to extend upward in the height direction "H". The fixing portion 10 fixes the first kind of contact 5 to the housing 4. The fixing portion 10 is provided with protruding portions 10*a* formed to protrude in the thickness direction "T" for engaging with a respective fixing hole, which will be explained later, provided in the housing 4.

Figure 13:
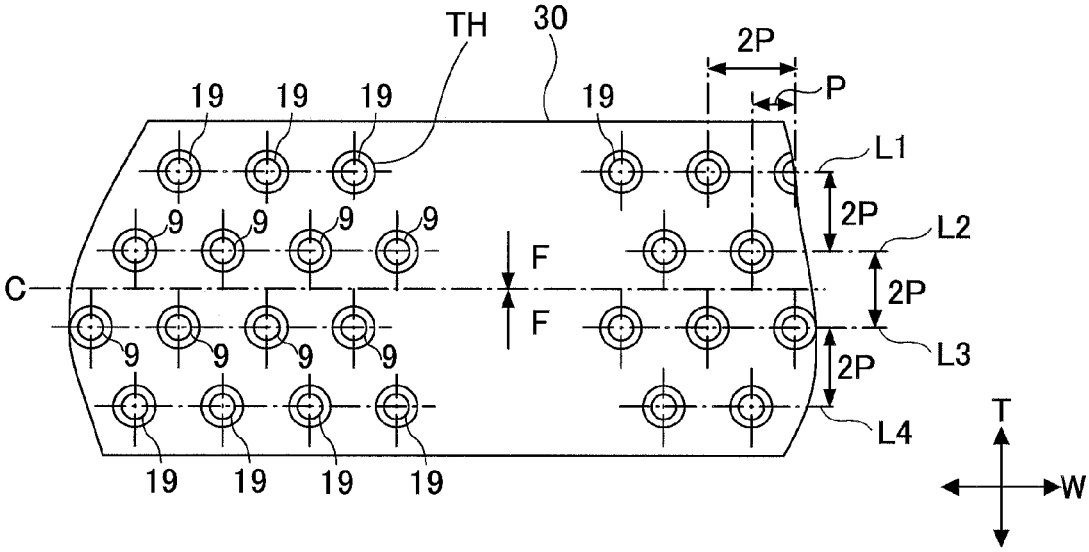
FIG. 13 is a view showing the alignment of second terminals of the connector and through holes of a substrate of the first embodiment.

The second terminal 9 is composed of an extending portion extending in the height direction "H" intended to fit with the through hole TH of the substrate 30 (see FIG. 13). The second terminal 9 is provided with a flexible portion formed at its middle part in the height direction "H" to engage with the respective through hole TH of the substrate 30. The flexible portion may be formed by a circular ring. With this structure, the second terminal 9 can be electrically connected to the through hole TH of the substrate 30 by a press-fit.

In this embodiment, the second terminal 9 is formed near the first end of the base portion 105 at the connecting portion 12 to extend downward in the height direction "H". It means that the second terminal 9 is shifted from the fixing portion 10 and positioned at the same side as the first contact portion 6 and the second contact portion 7 in the thickness direction "T", for the first kind of contact 5. The shift amount between the second terminal 9 (the first contact portion 6 or the second contact portion 7) and the respective fixing portion 10 may be set approximately two times (2P) the predetermined pitch "P".

The bending portion 11 is provided at the second end of the support portion 8 to shift (offset) the position of the support portion 8 with respect to the connecting portion 12 in the width direction "W". Therefore, with the bending portion 11, the first contact portion 6 and the second contact portion 7 are shifted with respect to the fixing portion 10 and the second terminal 9 in the width direction "W".

Referring back to FIG. 1A, a dotted line "C" (hereinafter referred to as the center line "C" as well) expresses the center of the opening portion 4*a* of the housing 4 in the pushing direction "F". When the card edge connector 3 is inserted into the opening portion 4*a* of the housing 4, the center of the card edge connector 3 in its width direction "W" is also positioned on the center line "C". When the card edge connector 3 is inserted into the opening portion 4*a* of the housing 4, the first kind of contacts 5 and the second kind of contacts 15 push the pads 2 of the card edge connector 3 from both sides of the card edge connector 3 as shown by arrows F toward the center shown by the dotted line "C".

The structure of the second contact portion 7 will now be explained in detail. As shown in FIG. 7A, the second contact portion 7 is formed to extend upward from the first end 8*a* of the support portion 8 with being inclined toward the direction opposite of the pushing direction "F", protrude toward the pushing direction "F" to form the second contact surface 7*a*, and then further extend upward while being inclined toward the opposite direction of the pushing direction "F". The second contact portion 7, as a whole, is formed to have a bit of a flattened and inclined "Z" shape.

The structure of the first contact portion 6 will now be explained in detail. As shown in FIG. 7A, the first contact portion 6 is formed to extend from the end 8*b* of the branch portion 8*c* upward to a height higher than the second contact surface 7*a* of the second contact portion 7 and bend toward the pushing direction "F" while further bending downward to form the first contact surface 6*a* above the second contact surface 7*a*. The first contact portion 6, as a whole, is formed to have a reversed "J" in the vertical direction.

Figure 7B:
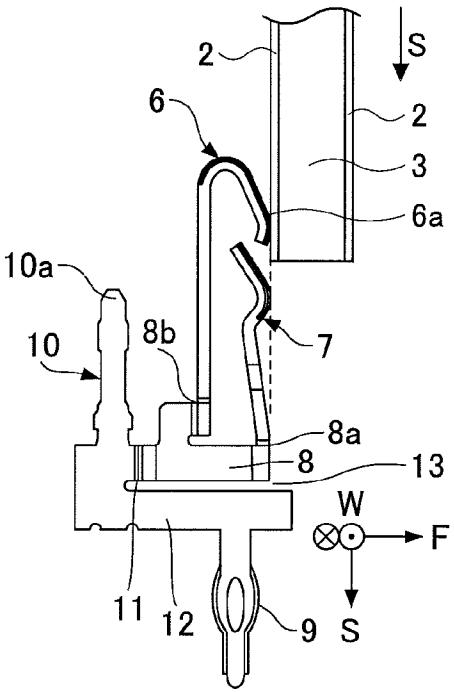
FIG. 7B and FIG. 7C are views explaining the relationship between a first contact portion, a second contact portion, and the card edge connector of the first embodiment.
Figure 7C:
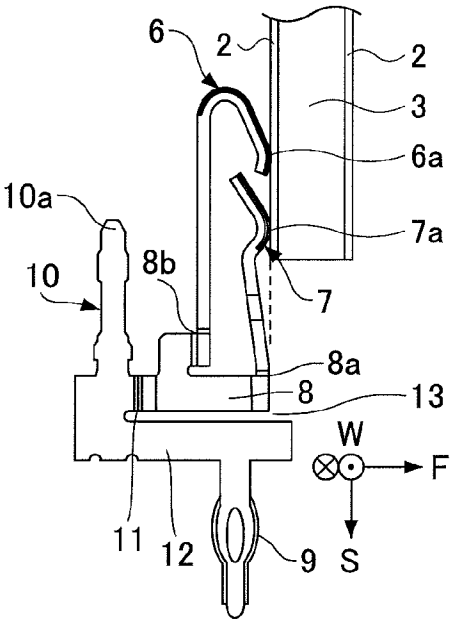

FIG. 7B and FIG. 7C are views explaining the relationship between the first contact portion 6, the second contact portion 7, and the card edge connector 3.

With the above structure of the first contact portion 6 and the second contact portion 7, when the card edge connector 3 is inserted downward toward the first end 8*a* side of the support portion 8, the first contact surface 6*a* of the first contact portion 6 contacts the respective pad 2 of the card edge connector 3 as shown in FIG. 7B. Then, when the card edge connector 3 is further inserted downward, the second contact surface 7*a* of the second contact portion 7 contacts the respective pad 2 of the card edge connector 3 as shown in FIG. 7C.

As described above, as the support portion 8 separately supports the first contact portion 6 and the second contact portion 7 at different positions in the thickness direction "T" (or in the pushing direction "F"), even when a reaction force is generated from the pad 2 when the pad 2 contacts the first contact surface 6*a* of the first contact portion 6, the force does not transmit to the second contact portion 7. Therefore, the pushing force of the second contact portion 7 can be controlled independently from the first contact portion 6.

The first end 8*a* of the support portion 8 and the end 8*b* of the branch portion 8*c* are positioned to have enough distance such that the first contact portion 6 and the second contact portion 7 are mechanically independent from each other in the pushing direction "F".

Further, in this embodiment, the second terminal 9 is also supported by the base portion 105 which is mechanically independent from the first contact portion 6 and the second contact portion 7. In this embodiment, as there is the slit portion 13 between the support portion 8 and the connecting portion 12, the force generated to the first contact portion 6 or the second contact portion 7 does not directly transmit to the second terminal 9 in the height direction "H". Therefore, the second terminal 9 is not influenced by the first contact portion 6 or the second contact portion 7.

It means that the base portion 105 is configured to support the first terminal (the first contact portion 6 and the second contact portion 7) and the second terminal 9 such that a "path" between the connecting ends (8*a* and 8*b*) of the first terminal and a connecting end of the second terminal 9 at the base portion 105 includes a portion extending in a direction perpendicular to the extending direction of the first contact portion 6 and the second contact portion 7. Therefore, the force generated to the first contact portion 6 or the second contact portion 7 can be reduced at such a portion of the "path".

Further, as the support portion 8 is shifted from the connecting portion 12 by the bending portion 11, even when the support portion 8 is moved downward by the force generated to the first contact portion 6 or the second contact portion 7, the connecting portion 12 is not influenced.

The first kind of contact 5 may be composed of a material having an electrical conductivity and elasticity such as a metal or the like and formed into the intended shape by pressing, bending or the like. The material may be a copper alloy or the like. Further, plating may be performed for the first contact surface 6*a* and the second contact surface 7*a*.

Figure 9:
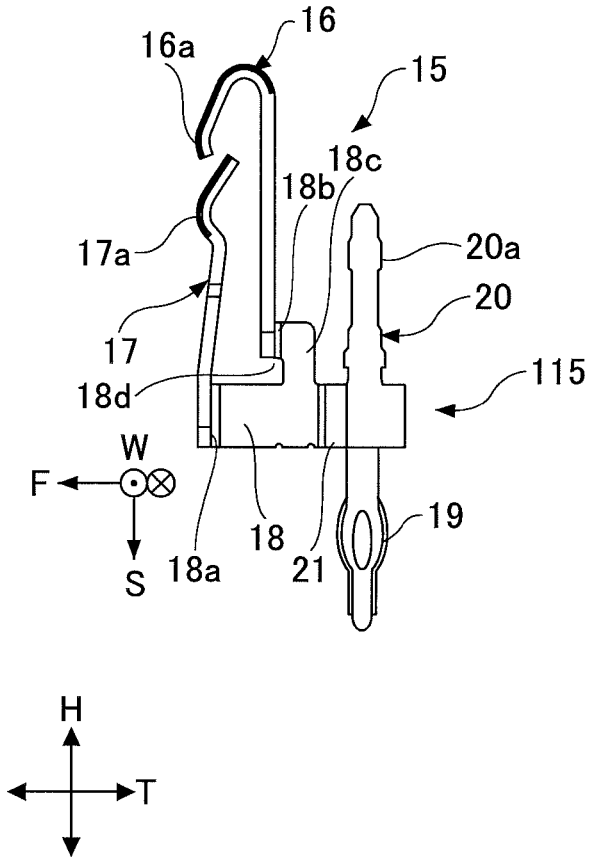
FIG. 9 is a side view of the second kind of contact of the first embodiment.
Figure 10:
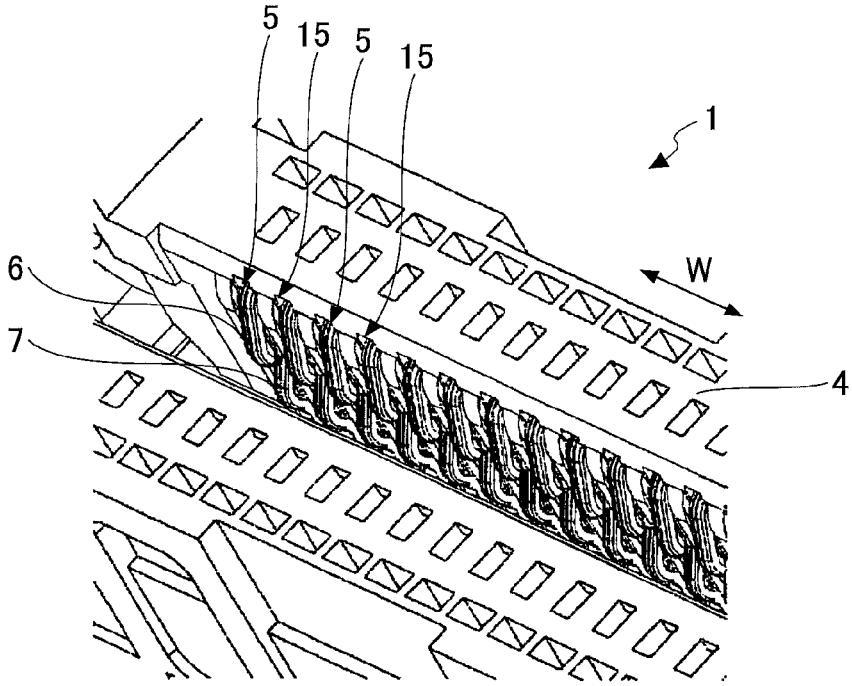
FIG. 10 is a partial view of the connector showing the first kind of contacts and the second kind of contacts of the first embodiment.

FIG. 10 is an enlarged perspective view of the second kind of contact 15. FIG. 9 is a side view of the second kind of contact 15.

As shown in FIG. 10 and FIG. 9, the second kind of contact 15 includes a base portion 115, a first terminal composed of a third contact portion (first contact portion), a fourth contact portion 17 (second contact portion), a second terminal 19 and a fixing portion 20.

The second kind of contact 15 has a structure and a function similar to those of the first kind of contact 5 and the explanation is not repeated.

Similar to the first kind of contact 5, the second kind of contact 15 is aligned in the housing 4 such that the base portion 115 extends in the thickness direction "T" of the housing 4.

The base portion 115 is provided with a support portion 18 and a bending portion 21.

The support portion 18 separately supports the third contact portion 16 and the fourth contact portion 17 at different positions in the thickness direction "T" of the housing 4.

Concretely, the fourth contact portion 17 is formed at a first end 18*a* (left end in FIG. 9) of the support portion 18 to extend upward in the height direction "H".

Further, in this embodiment, the support portion 18 is provided with a branch portion 18*c* formed at its second end side opposite to the first end 18*a* that is branched upward from the support portion 18. Therefore, the support portion 18 is formed to have a shape like an L reversed in the lateral direction where the vertical line is shorter than the lateral line.

The third contact portion 16 is formed at an end 18*b* of the branch portion 18*c* to extend upward in the height direction "H". Further, the branch portion 18*c* and the third contact portion 16 are provided to form a gap 18*d* between the extending portion of the support portion 18 and the third contact portion 16.

Similar to the first kind of contact 5 described above with respect to FIG. 7B and FIG. 7C, for the second kind of contact 15, the card edge connector 3 is inserted from the first end 18*a* side of the support portion 18. Therefore, the third contact portion 16 and the fourth contact portion 17 are formed to have a third contact surface 16*a* and a fourth contact surface 17*a* protruding toward the first end 18*a* side of the support portion 18 to face the first end 18*a* side, respectively. The support portion 18 supports the third contact portion 16 and the fourth contact portion 17 such that the third contact surface 16*a* and the fourth contact surface 17*a* are positioned in the same plane facing the first end 18*a* side. In this embodiment, the support portion 18 supports the third contact portion 16 and the fourth contact portion 17 such that the third contact surface 16*a* and the fourth contact surface 17*a* are positioned on a same line but at different positions in the height direction "H". Concretely, the third contact surface 16*a* is formed to be positioned higher than (above) the fourth contact surface 17*a*.

With this structure, the third contact surface 16*a* of the third contact portion 16 and the fourth contact surface 17*a* of the fourth contact portion 17 respectively contact and push the card edge connector 3 toward the first end 18*a* side of the support portion 18 in the pushing direction "F". The structure of the third contact portion 16 and the fourth contact portion 17 will be explained later.

The third contact surface 16*a* of the third contact portion 16 and the fourth contact surface 17*a* of the fourth contact portion 17 are positioned at the same height as the first contact surface 6*a* of the first contact portion 6 and the second contact surface 7*a* of the second contact portion 7, respectively.

The fixing portion 20 is formed at a second end (right end in FIG. 9) of the base portion 115 opposite to the first end 18*a* of the support portion 18 to extend upward in the height direction "H". The fixing portion 20 fixes the second kind of connector 15 to the housing 4. The fixing portion 20 is provided with protruding portions 20*a* formed to protrude in the thickness direction "T" for engaging with the respective fixing hole, which will be explained later, provided in the housing 4.

The second terminal 19 is composed of an extending portion extending in the height direction "H" intended to fit with the through hole TH of the substrate 30 (see FIG. 13). For the second kind of contact 15, the second terminal 19 is also formed at the second end (right end in FIG. 9) of the base portion 115 to extend downward in the height direction "H". It means that the base portion 115 of the second kind of contact 15 does not include a portion like the connecting portion 12 of the first kind of contact 5. The fixing portion 20 is formed above the second terminal 19. The third contact portion 16 and the fourth contact portion 17 are positioned at a different side and are shifted from the fixing portion 20 and the second terminal 19 in the thickness direction "T", for the second kind of contact 15. The shift amount between the third contact portion 16 and the fourth contact portion 17, and the fixing portion 20 and the second terminal 19 may be set approximately two times (2P) of the predetermined pitch "P". Therefore, when the first kind of contacts 5 and the second kind of contacts 15 are alternatively aligned in the same line such that the first contact surfaces 6*a* of the first contact portions 6 and the third contact surfaces 16*a* of the third contact portions 16 are aligned on a line, the corresponding fixing portions 10 and the fixing portions 20 are also aligned on a line as shown in FIG. 8B, which will be explained later.

The second terminal 19 is provided with a flexible portion formed at its middle part in the height direction "H" to engage with the respective through hole TH of the substrate 30. The flexible portion may be composed by a circular ring. With this structure, the second terminal 19 can be electrically connected to the through hole TH of the substrate 30 by a press-fit.

The bending portion 21 is provided at the second end of the support portion 18 to shift (offset) the position of the support portion 18 with respect to the rest of the base portion 115 in the width direction "W". Therefore, with the bending portion 21, the third contact portion 16 and the fourth contact portion 17 are shifted with respect to the fixing portion 20 and the second terminal 19 in the width direction "W".

The shift amount by the bending portion 21 of the base portion 115 of the second kind of contact 15 may be set equal to the shift amount of the bending portion 11 of the base portion 105 of the first kind of contact 5.

The structure of the fourth contact portion 17 is explained in detail. The fourth contact portion 17 has a similar structure as the second contact portion 7 of the first kind of contact 5.

As shown in FIG. 9, the fourth contact portion 17 is formed to extend upward from the first end 18*a* of the support portion 18 while being inclined toward an opposite direction of the pushing direction "F", protrude toward the pushing direction "F" to form the fourth contact surface 17*a*, and then further extend upward with being inclined toward the opposite direction of the pushing direction "F".

The fourth contact portion 17, as a whole, is formed to have a bit flattened and inclined "Z" shape reversed in the lateral direction.

The structure of the third contact portion 16 is explained in detail. The third contact portion 16 has a similar structure as the first contact portion 6 of the first kind of contact 5.

The third contact portion 16 is formed to extend upward from the end 18*b* of the branch portion 18*c* to a height higher than the second contact surface 17*a* of the fourth contact portion 17 and bend toward the pushing direction "F" while being further bent downward to form the third contact surface 16*a* above the fourth contact surface 17*a*. The third contact portion 16, as a whole, is formed to have a reversed "J" in the vertical direction and in the lateral direction.

Here, FIG. 9 shows the structure of the second kind of contact 15 which is intended to face the first kind of contact 5 shown in FIG. 7A. However, the second kind of contact 15 which is positioned in the same alignment line with the first kind of contact 5 shown in FIG. 7A, has the structure reversed from that shown in FIG. 9 in the lateral direction.

As described above, as the support portion 18 separately supports the third contact portion 16 and the fourth contact portion 17 at different positions in the thickness direction "T" (or in the pushing direction "F"), even when a reaction force is generated from the pad 2 when the pad 2 contacts the third contact surface 16*a* of the third contact portion 16, the force does not transmit to the fourth contact portion 17. Therefore, the pushing force of the fourth contact portion 17 can be controlled independently from the third contact portion 16.

The first end 18*a* of the support portion 18 and the end 18*b* of the branch portion 18*c* are positioned to have enough distance such that the third contact portion 16 and the fourth contact portion 17 are mechanically independent from each other in the pushing direction "F".

Further, in this embodiment, the second terminal 19 is also supported by the base portion 115 mechanically independent from the third contact portion 16 and the fourth contact portion 17. In this embodiment, as the second terminal 19 is positioned at the different side from the third contact portion 16 and the fourth contact portion 17 in the thickness direction "T", the force generated to the third contact portion 16 or the fourth contact portion 17 does not directly transmit to the second terminal 19 in the height direction "H". Therefore, the second terminal 19 is not influenced by the third contact portion 16 or the fourth contact portion 17.

It means that the base portion 115 is configured to support the first terminal (the third contact portion 16 and the fourth contact portion 17) and the second terminal 19 such that a "path" between the connecting ends (18*a* and 18*b*) of the first terminal and a connecting end of the second terminal 19 at the base portion 115 includes a portion extending in a direction perpendicular to the extending direction of the third contact portion 16 and the fourth contact portion 17. Therefore, the force generated to the third contact portion 16 or the fourth contact portion 17 can be reduced at such a portion of the "path".

Similar to the first kind of contact 5, the second kind of contact 15 may be composed of a material having an electrical conductivity and elasticity such as a metal or the like and formed into the intended shape by pressing, bending or the like. The material may be a copper alloy or the like. Further, plating may be performed for the third contact surface 16*a* and the fourth contact surface 17*a*.

Figure 2:
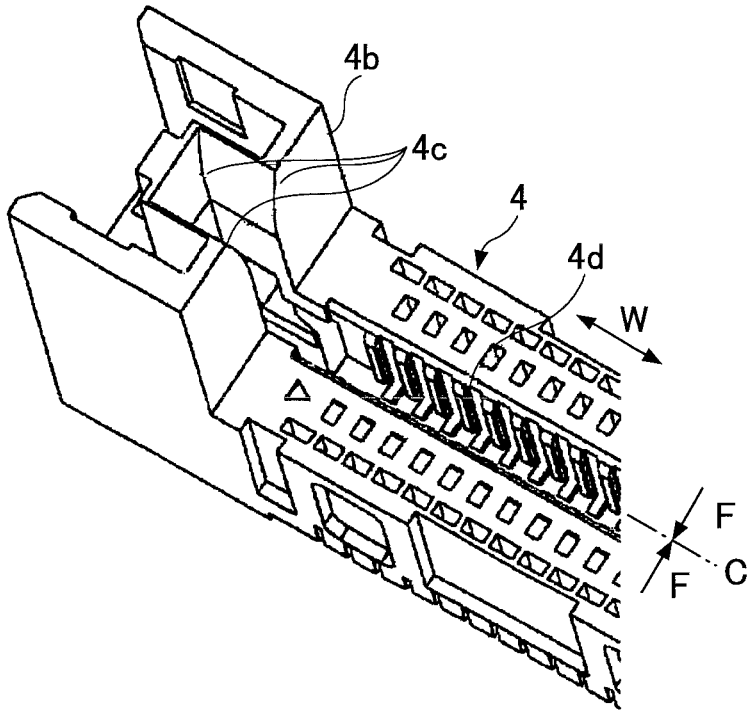
FIG. 2 is a partial view of a housing of the connector of the first embodiment.
Figure 3:
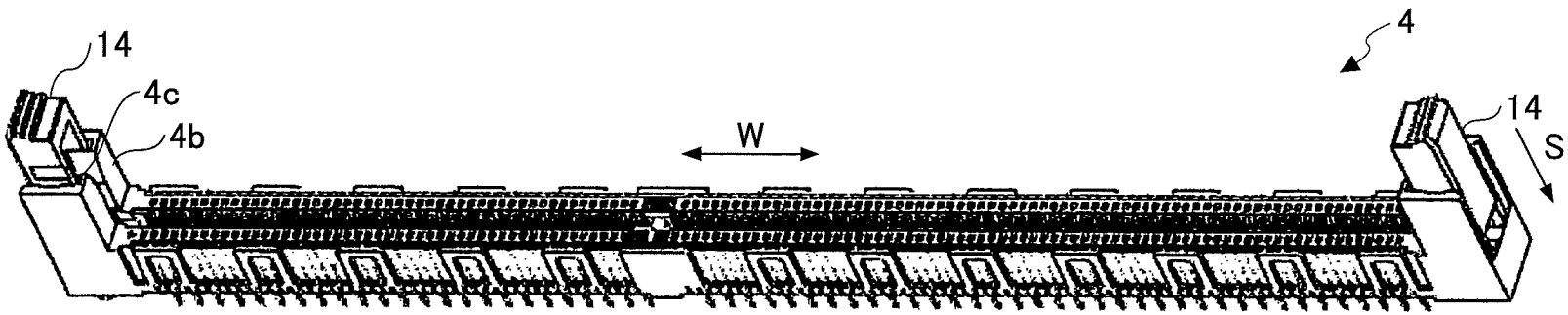
FIG. 3 is a perspective view of the housing of the first embodiment.

The structure of the housing 4 of the connector 1 of the first embodiment is explained. FIG. 2 is a partial view of the housing 4 of the connector 1. FIG. 3 is a perspective view of the housing 4.

The housing 4 is further provided with guide portions 4*b*, tapered portions 4*c* and protruding portions 4*d*.

The guide portions 4*b* are provided at both ends of the housing 4 in the width direction "W" to protrude upward. The tapered portions 4*c* are respectively provided to the guide portions 4*b* for smoothly receiving the card edge connector 3 when the card edge connector 3 is inserted into the opening portion 4*a* of the housing 4.

The protruding portions 4*d* are formed to be aligned in the width direction "W" at the side walls of the housing 4 facing each other in the opening portion 4*a*. The protruding portions 4*d* are formed to protrude toward the pushing direction "F". Further, the protruding portions 4*d* are formed at the positions where the first kind of contacts 5 and the second kind of contacts 15 are not to be positioned in order to touch the surface of the card edge connector 3 between the adjacent pads 2.

When the card edge connector 3 is inserted into the opening portion 4*a* of the housing 4, first, the card edge connector 3 is guided by the tapered portion 4*c*. Then, when the card edge connector 3 is further inserted into the opening portion 4*a*, both surfaces of the card edge connector 3 touch the protruding portions 4*d* at the positions where the pads 2 are not formed while the pads 2 are contacted by the first kind of contacts 5 and the second kind of contacts 15. As the protruding portions 4*d* also touch the card edge connector 3, even when the card edge connector 3 is warped or deformed, the card edge connector 3 can surely be supported within the opening portion 4*a* of the housing 4 and interference by the card edge connector 3 to the part of the housing 4, other than the protruding portions 4*d*, can be prevented.

Further as shown in FIG. 3, the connector 1 of the embodiment further includes hooks 14 provided to fit with the guide portions 4*b* to fix the card edge connector 3 to the housing 4 after the card edge connector 3 is inserted into the opening portion 4*a* of the housing 4.

Figure 4:
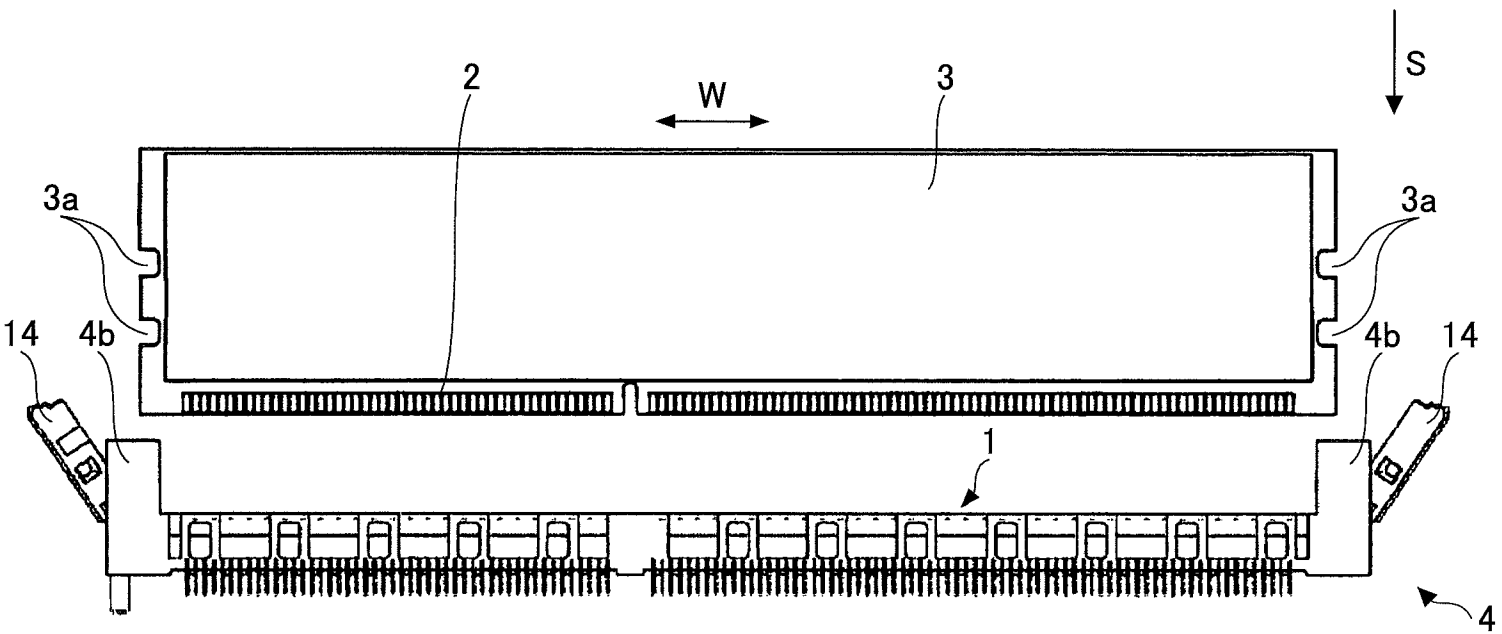
FIG. 4 to FIG. 6 are views for explaining the connection between the connector and the card edge connector.
Figure 5:
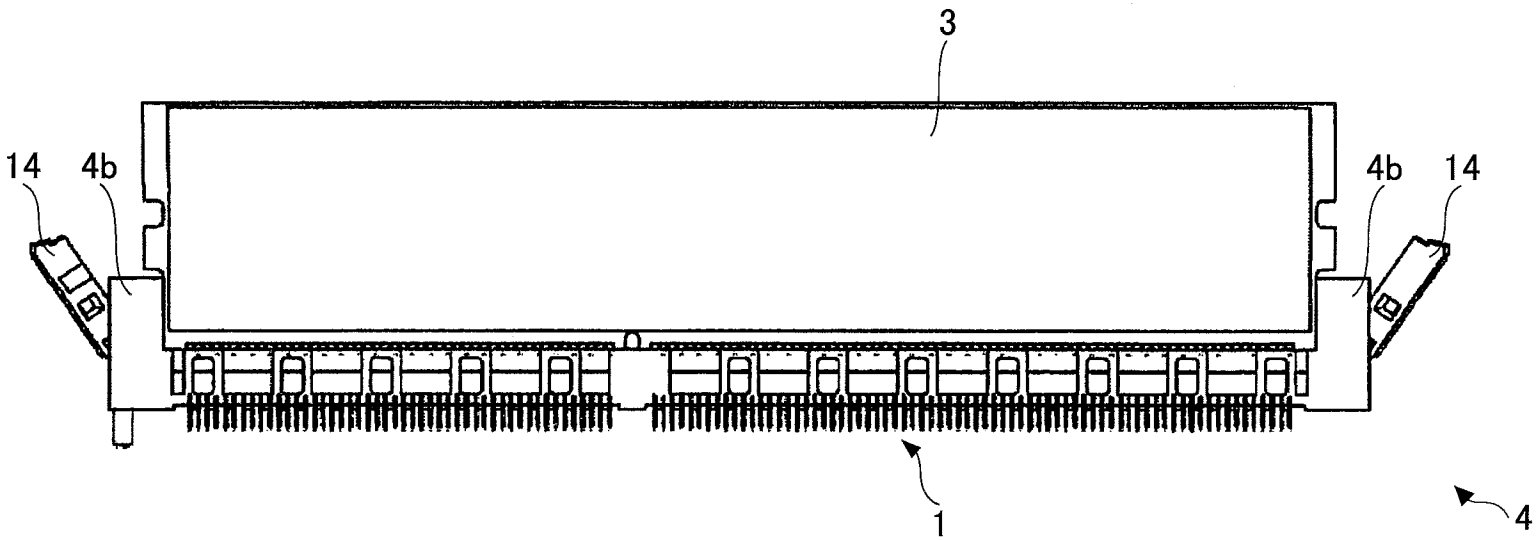
Figure 6:
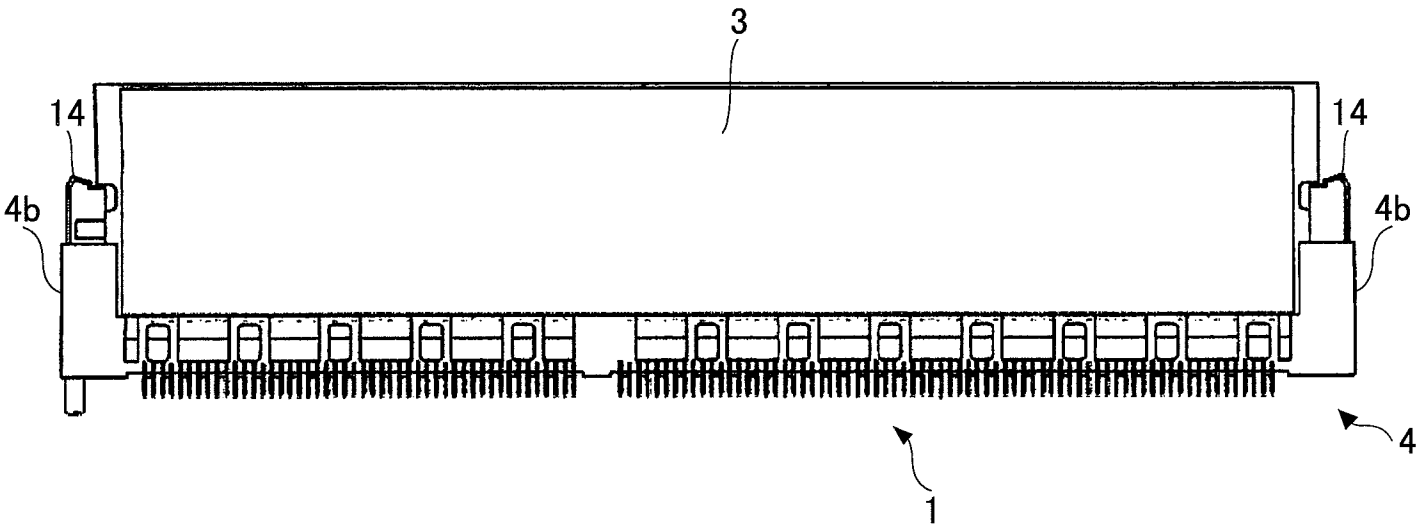

The structure and the operation of fixing the card edge connector 3 to the housing 4 are explained in detail with reference to FIG. 4 to FIG. 6. FIG. 4 to FIG. 6 are views for explaining the connection between the connector 1 and the card edge connector 3.

The card edge connector 3 is provided with notch portions 3*a* at both ends in the width direction "W".

The hooks 14 are opened while being inclined outward in the width direction "W" as shown in FIG. 4. Under this condition, the card edge connector 3 is inserted downward into the opening portion 4*a* (not shown in FIG. 4 to FIG. 6 though) of the housing 4 of the connector 1. After the card edge connector 3 is completely inserted in the housing 4 of the connector as shown in FIG. 5, the hooks 14 are engaged with the notch portions 3*a* to fix the card edge connector 3 to the connector 1 as shown in FIG. 6.

Figure 8A:
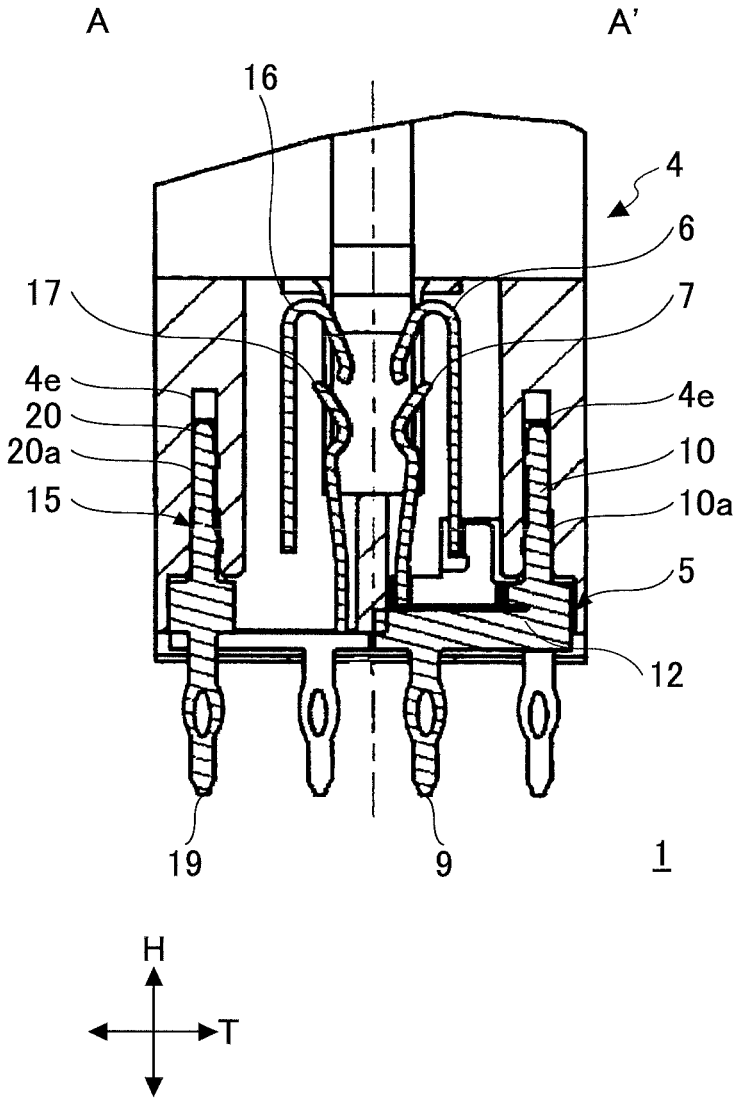
FIG. 8A is a cross-sectional view of the connector of the first embodiment.
Figure 8B:
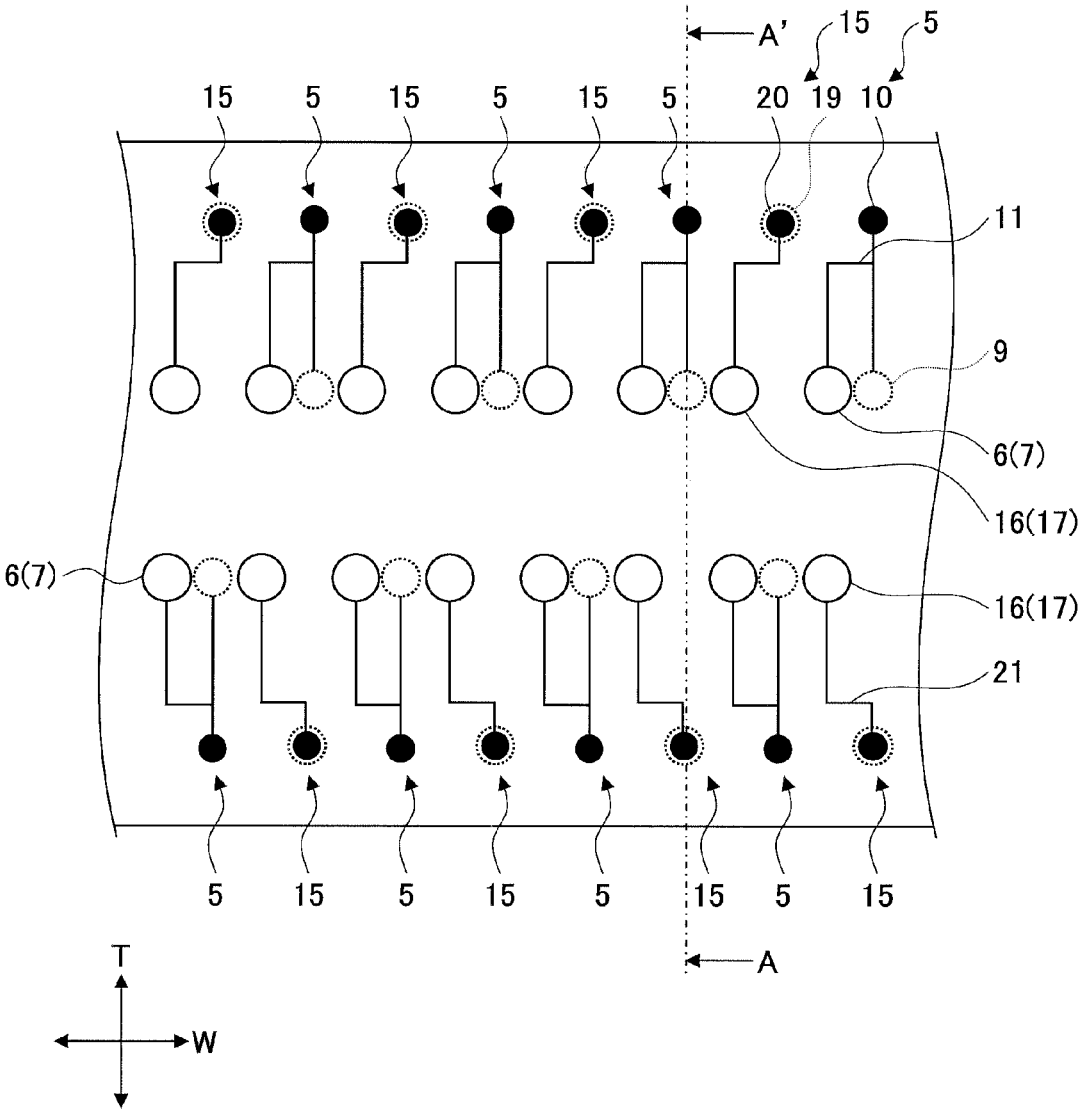
FIG. 8B is a plan view showing the alignment of the first kind of contacts and the second kind of contacts.

FIG. 8A is a cross-sectional view of the connector 1 of the first embodiment in the thickness direction "T". FIG. 8B is a plan view showing the alignment of the first kind of contacts 5 and the second kind of contacts 15. FIG. 8A corresponds to a cross-sectional view taken along an A-A' line in FIG. 8B.

Referring to FIG. 8A, the housing 4 is further provided with plural fixing holes 4*e* in which the protruding portions 10*a* of the fixing portions 10 of the first kind of contacts 5 or the protruding portions 20*a* of the fixing portions 20 of the second kind of contacts 15 are inserted to be engaged.

Although the first contact portion 6 and the second contact portion 7 of the first kind of contacts 5 are shifted with respect to the fixing portion 10 and the second terminal 9 by the bending portion 11 in the width direction "W" as explained above, the contact portion 6 and the second contact portion 7 are also shown in FIG. 8A for explanation.

Similarly, the third contact portion 16 and the fourth contact portion 17 of the second kind of contact 15 are shifted with respect to the fixing portion 20 and the second terminal 19 by the bending portion 21 in the width direction "W" as explained above, the third contact portion 16 and the fourth contact portion 17 are also shown in FIG. 8A for explanation.

As described above, the first kind of contacts 5 and the second kind of contacts 15 are alternatively aligned in the width direction "W" while facing each other having the center line "C" of the opening portion 4*a* of the housing as a center.

Figure 11:
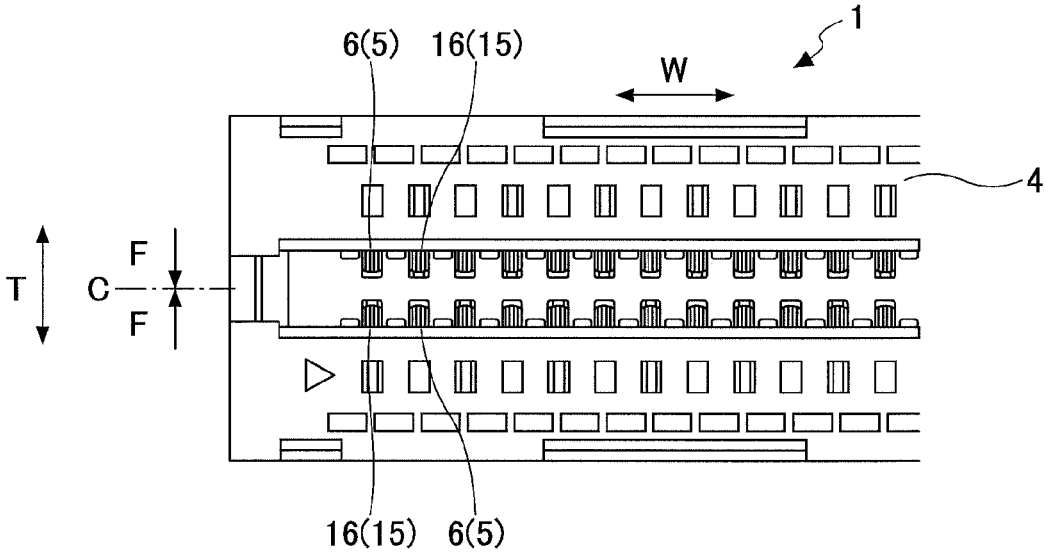
FIG. 11 is a plan view of the connector of the first embodiment.
Figure 12:
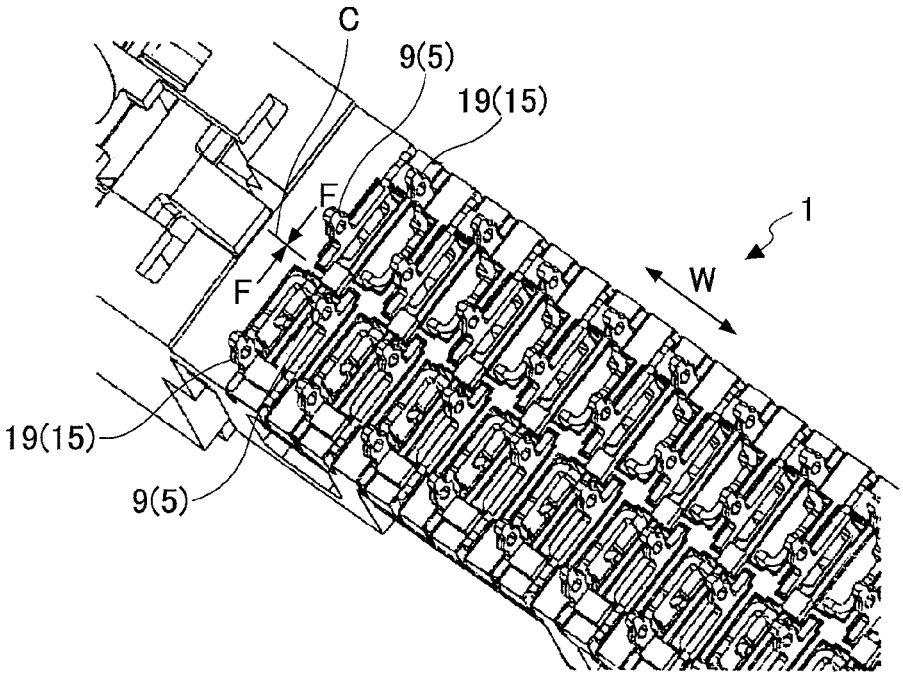
FIG. 12 is a bottom view of the connector of the first embodiment.

The alignment of the first kind of contacts 5 and the second kind of contacts 15 is explained with reference to FIG. 10 to FIG. 12. FIG. 10 is a partial view of the connector 1 showing the first kind of contacts 5 and the second kind of contacts 15. FIG. 11 is a plan view of the connector 1. FIG. 12 is a bottom view of the connector 1.

As shown in FIG. 10, the first kind of contacts 5 and the second kind of contacts 15 are alternatively aligned in the width direction "W". Further, as shown in FIG. 11, the first contact portion 6 of the first kind of contacts 5 and the third contact portions 16 of the second kind of contacts 15 are alternatively aligned in the width direction "W". Further, the connector 1 of the embodiment includes two alignment lines of the first kind of contacts 5 and the second kind of contacts 15 aligned such that the first contact portion 6 of the first kind of contact 5 faces the third contact portion 16 of the second kind of contact 15 having the center line "C" interposed therebetween.

Further, as shown in FIG. 12, the second terminals 9 of the first kind of contacts 5 and the second terminals 19 of the second kind of contacts 15 are alternatively aligned in a zigzag form (in a diamond pattern) in the width direction "W" and in the thickness direction "T". Further, the second terminals 9 of the first kind of contacts 5 are positioned closer to the center line "C" in the pushing direction "F" while the second terminals 19 of the second kind of contacts 15 are positioned further from the center line "C" in the pushing direction "F".

FIG. 13 is a view showing the alignment of the second terminals 9 and the second terminals 19 of the connector 1 and the through holes TH of the substrate 30.

As explained above with reference to FIG. 1A, the plural pads 2 are aligned with the predetermined pitch "P" in the width direction "W". Therefore, the first contact portions 6 and the second contact portions 7 of the first kind of contacts 5, and the third contact portions 16 and the fourth contact portions 17 of the second kind of contacts 15 are aligned with the predetermined pitch "P" in the width direction "W" corresponding to the pads 2 of the card edge connector 3. The second terminals 9 and the second terminals 19 which are alternatively aligned in the width direction "W", are aligned with the predetermined pitch "P" in the direction "W" as shown in FIG. 13. In other words, the distance between the adjacent second terminals 9 or the adjacent second terminals 19 in the width direction "W" become "2P" as shown in FIG. 13.

As described above, the shift amount between the first contact portion 6 (or the second contact portion 7) and the respective fixing portion 10 of the first kind of contact 5, and the shift amount between the third contact portion 16 (or the fourth contact portion 17) and the respective fixing portion 20 of the second kind of contact 15 may be set approximately equal to "2P". In this case, the distance between a center line L2 (or L3) of the aligned second terminals 9 and a center line L1 (or L4) of the aligned second terminals 19 positioned at either side of the center line "C" in the thickness direction "T" becomes "2P" as shown in FIG. 13.

Further, the distance between the center lines L2 and L3 of the aligned second terminals 9 having the center line "C" interposed therebetween may depend on the size of the opening portion 4*a* of the housing 4 (thickness of the card edge connector 3) so that the card edge connector 3 can be inserted into the opening portion 4*a*. However, if possible, the distance between the center lines L2 and L3 may be set "2P" as shown in FIG. 13. With this structure, the pitch of the through holes TH of the substrate 30 in the thickness direction "T" can be set equally to "2P". Further, the pitch of the through holes TH of the substrate 30 in the width direction "W" can also be set equal to "2P".

As shown in FIG. 13, the second terminals 9 and the second terminals 19 can be aligned in a zigzag manner (in a diamond pattern), not in a grid. Therefore, the through holes TH of the substrate 30 corresponding to the second terminals 9 and the second terminals 19 can be aligned in a zigzag manner. With this structure, the alignment density of the through holes TH of the substrate 30 can be increased.

As described above, according to the connector 1 of the first embodiment, the second terminals 9 and the second terminals 19 can be aligned in a zigzag manner while the through holes TH of the substrate 30 can also be aligned in a zigzag manner.

Further, according to the connector 1 of the first embodiment, the structure of the first kind of contacts 5 and the second kind of contacts 15 can also be appropriately adjusted to actualize the alignment of the through holes TH in a zigzag manner.

Concretely, two kinds of contacts, for one of which (the first kind of contact 5) the second terminal 9 is provided at the same side as the first terminal (the first contact portion 6 and the second contact portion 7) in the thickness direction "T", while the other of which (the second kind of contact 15) the second terminal 19 is provided at a different side from the first terminal (the third contact portion 16 and the fourth contact portion 17) in the thickness direction "T" are provided. Therefore, the alignment density of the contacts can be increased.

According to the connector 1 of the first embodiment, when inserting the card edge connector 3 into the housing 4, the first contact surfaces 6*a* of the first contact portions 6, or the third contact surfaces 16*a* of the third contact portions 16 touch the respective pads 2 of the card edge connector 3 to wipe the surfaces of the pads 2 and remove contaminants on the surfaces prior to the second contact surfaces 7*a* of the second contact portions 7 or the fourth contact surfaces 17*a* of the fourth contact portions 17. Therefore, the electrical connection between the second contact portions 7 or the fourth contact portions 17 and the pads 2 can be ensured.

Further, as the first contact portion 6 and the second contact portion 7 are separately supported by the support portion 8 from different positions in a direction perpendicular to the inserting direction "S", the first contact portion 6 and the second contact portion 7 can be mechanically independent from each other. In other words, when the first contact surface 6*a* of the first contact portion 6 touches the pad 2, the reaction force from the pad 2 toward the first contact portion 6 does not transmit to the second contact portion 7. Therefore, the pushing force of the second contact portion 7 toward the pad 2 can be stabilized.

Similarly, as the third contact portion 16 and the fourth contact portion 17 are separately supported by the support portion 18 from the different positions in a direction perpendicular to the inserting direction "S", the third contact portion 16 and the fourth contact portion 17 can be mechanically independent from each other. In other words, when the third contact surface 16*a* of the third contact portion 16 touches the pad 2, the reaction force from the pad 2 toward the third contact portion 16 does not transmit to the fourth contact portion 17. Therefore, the pushing force of the fourth contact portion 17 toward the pad 2 can be stabilized.

This means that the reliance in the electrical connection between the connector 1 and the card edge connector 3 can be increased by removing any contaminant on the surface of the pad 2 by the first contact surface 6*a* or the third contact surface 16*a* and stabilizing the pushing force for contacting the second contact portion 7 or the fourth contact portion 17, respectively.

In addition, as the first kind of contact 5 and the second kind of contact 15 respectively include second terminals 9 and the second terminals 19 to be fitted in the through holes TH of the substrate 30, the connector 1 can be electrically connected to the substrate 30 by a press-fit, without using solder.

Further, as the base portion 105 of the first kind of contact 5 is provided with the slit portion 13 formed between the support portion 8 and the connecting portion 12, the support portion 8 by which the first contact portion 6 and the second contact portion 7 are supported, and the connecting portion 12 from which the second terminal 9 is extended can be mechanically independent from each other. Therefore, transmission of the reaction force toward the second terminal 9 via the support portion 8 can be prevented, which is applied to the first contact portion 6 and the second contact portion 7 when they touch the respective pad 2. With this, the electrical connection between the second terminal 9 and the respective through hole TH can be ensured to improve the reliance.

For the second kind of contact 15, as the second terminal 19 is shifted from the third contact portion 16 and the fourth contact portion 17, transmission of the reaction force toward the second terminal 9 via the support portion 8 can be prevented, which is applied to the third contact portion 16 and the fourth contact portion 17 when they touch the respective pad 2. With this, the electrical connection between the second terminal 9 and the respective through hole TH can be ensured to improve the reliance.

Further, as the fixing portion 20 and the second terminal 19 are aligned on a line in the inserting direction "S", so that the second terminal 19 can be strongly held by the fixing portion 20 to suppress the displacement with respect to the through hole TH. Therefore, a slit portion like the slit portion 13 of the first kind of contact 5 is not provided to the second kind of contact 15.

Although in the first embodiment, the first contact portion 6 (or the third contact portion 16) and the second contact portion 7 (or the fourth contact portion 17) are separately supported from the different positions in the thickness direction "T" which is perpendicular to the inserting direction "S", other structures can be provided as follows.

Second Embodiment

Figure 14:
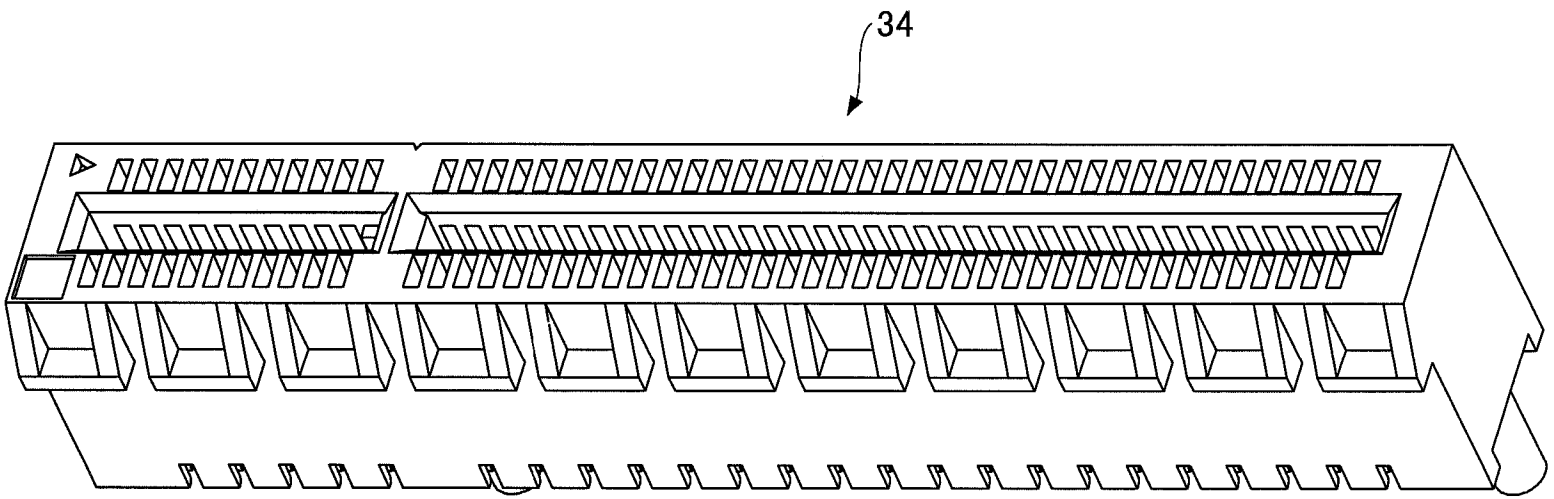
FIG. 14 is a perspective view of a housing of a connector of a second embodiment.
Figure 15:
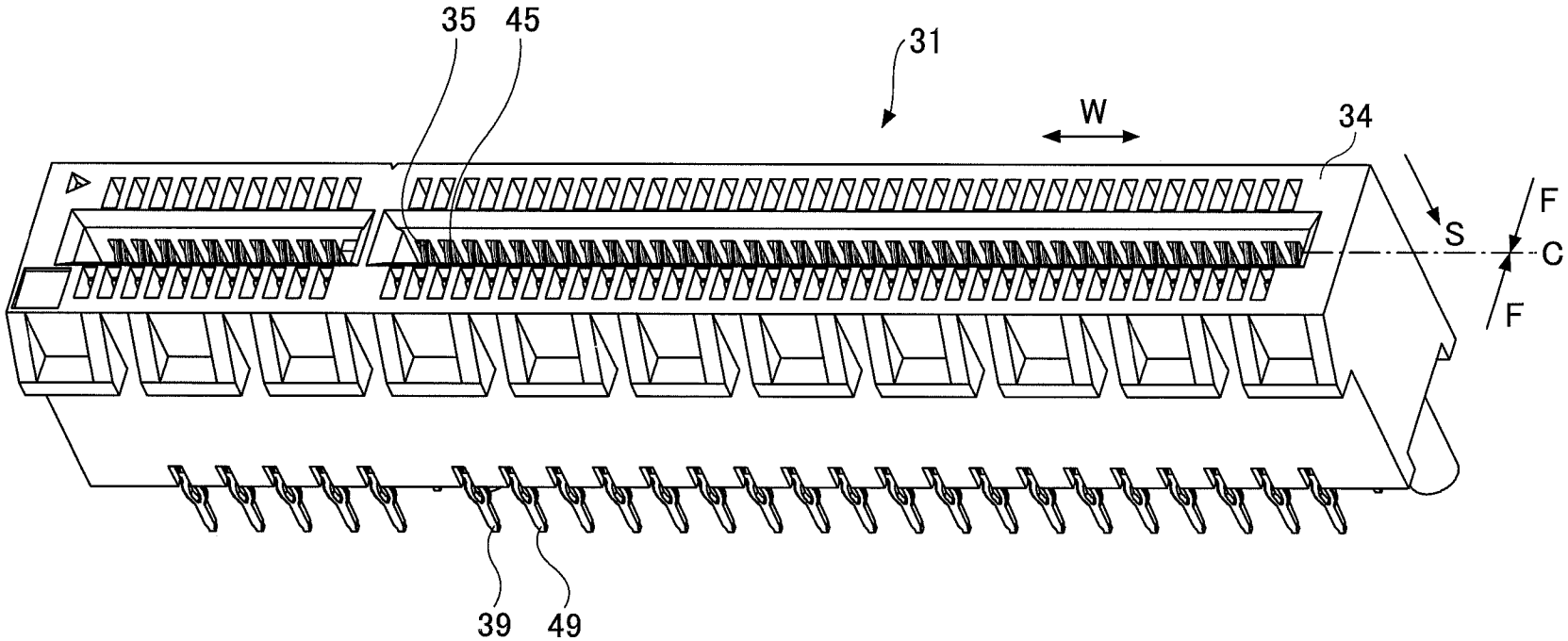
FIG. 15 is a perspective view of the connector including the housing, first kind of contacts and second kind of contacts of the second embodiment.

FIG. 14 is a perspective view of a housing 34 of a connector 31 of a second embodiment. FIG. 15 is a perspective view of the connector 31 including the housing 34, first kind of contacts 35 and second kind of contacts 45 of the second embodiment.

In this embodiment as well, the connector 31 is intended to electrically connect the card edge connector 3 (see FIG. 1) and the substrate 30 (see FIG. 13) similar to the connector 1 of the first embodiment. The structure of the card edge connector 3 may be similar to that described in the first embodiment.

The connector 31 includes the housing 34, plural of the first kind of contacts 35, and plural of the second kind of contacts 45.

Figure 16:
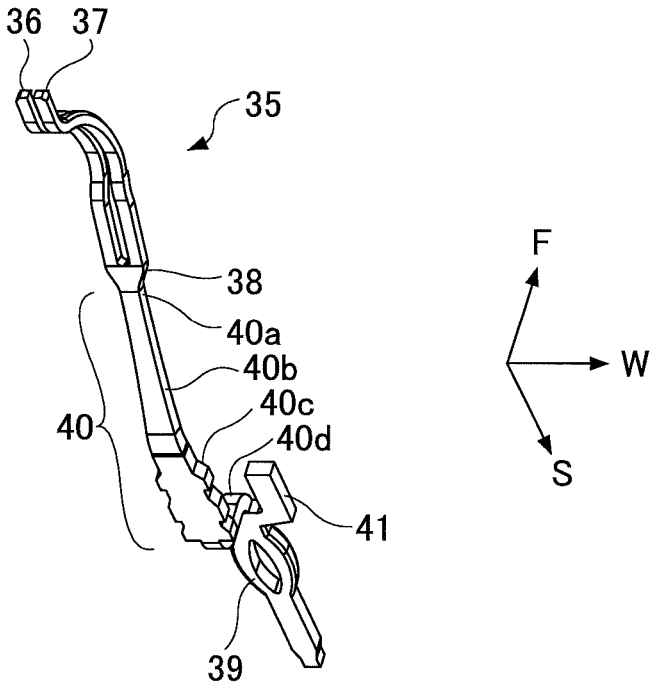
FIG. 16 is an enlarged perspective view of a first kind of contact of the second embodiment.
Figure 17C:
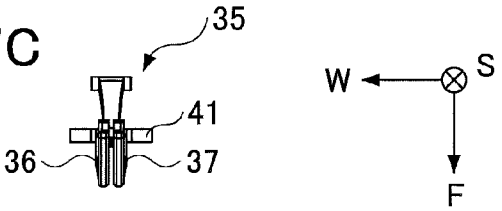
FIG. 17B is a plan view and FIG. 17C is a top view, of the first kind of contact of the second embodiment.
Figure 17B:
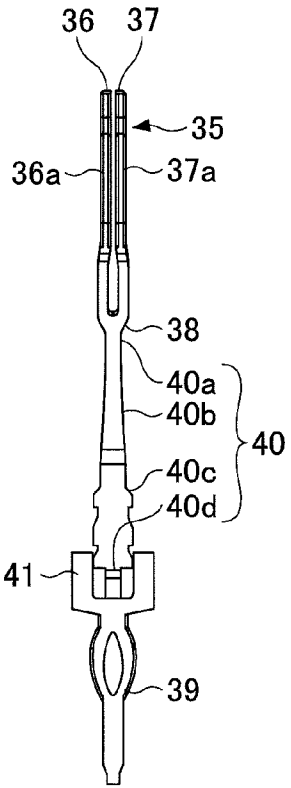
Figure 17A:
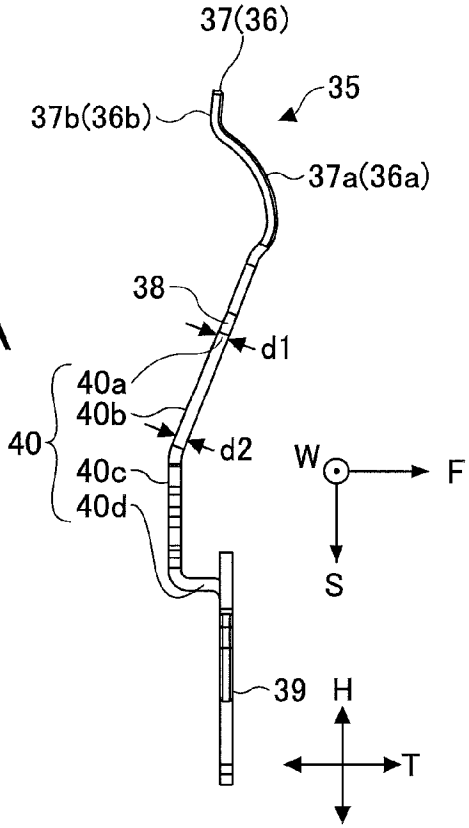
FIG. 17A is a side view.

FIG. 16 is an enlarged perspective view of the first kind of contact 35. FIG. 17A is a side view, FIG. 17B is a plan view and FIG. 17C is a top view, of the first kind of contact 35.

The first kind of contact 35 includes a base portion composed of a support portion 38 and a connecting portion 40, a first terminal composed of a first contact portion 36 and a second contact portion 37, a second terminal 39 and a stopper 41.

Similar to the first embodiment, the first terminal (the first contact portion 36 and the second contact portion 37) is intended to be connected with the respective pad 2 of the card edge connector 3 and the second terminal 39 is intended to be fitted in the through hole TH of the substrate 30 (see FIG. 13). In this embodiment as well, the first contact portion 36 and the second contact portion 37 composing the first terminal is configured to extend in the upper direction (first direction) and the second terminal 39 is configured to extend in the lower direction (second direction).

The support portion 38 separately supports the first contact portion 36 and the second contact portion 37 from the different positions in the width direction "W" of the housing 34. The support portion 38 has a triangle shape where a summit is positioned below to be connected to the connecting portion 40. The width of the support portion 38 becomes narrower the closer to the connecting portion 40.

In this embodiment, the first contact portion 36 and the second contact portion 37 of the first kind of contact 35 are extended from the support portion 38 in a parallel relationship with each other. The first contact portion 36 and the second contact portion 37 may be formed to be separated by a slit portion extending from the support portion 38. The first kind of contact 35 is aligned in the housing 34 such that the first contact portion 36 and the second contact portion 37 are aligned in the width direction "W".

The connecting portion 40 connects the support portion 38 and the second terminal 39. The connecting portion 40 includes an inclined portion 40*b*, a fixing portion 40*c* and a bending portion 40*d*.

The inclined portion 40*b* includes a neck portion 40*a* where the width in the width direction "W" is narrower than that of the support portion 38. Further, the width of the neck portion 40*a* is narrower than the other parts of the inclined portion 40*b*.

The inclined portion 40*b* is formed to have a width in the width direction "W" that becomes larger as closer to the second terminal 39. Further, the inclined portion 40*b* is formed to have a thickness in the thickness direction "T" that becomes larger as closer to the second terminal 39. As shown in FIG. 17A, the thickness "d2" near the bottom end of the inclined portion 40*b* is larger than the thickness "d1" at the neck portion 40*a*.

The fixing portion 40*c* is provided near the second terminal 39 and has protruding portions protruding in the width direction "W" to be fixed with the housing 34 to fix the first kind of contact 35 to the housing 34.

As shown in FIG. 17A, the bending portion 40*d* is formed to shift the second terminal 39 with respect to the fixing portion 40*c* in the pushing direction "F".

The stopper 41 is formed to protrude upward in FIG. 16, FIG. 17A or FIG. 17B. In this embodiment, the stopper 41 has two protruding portions to have a shape like a "U".

As shown in FIG. 17A, the first contact portion 36 and the second contact portion 37 are provided with a first contact surface 36*a* and a hook portion 36*b*, and a second contact surface 37*a* and a hook portion 37*b*, respectively. The support portion 38 supports the first contact portion 36 and the second contact portion 37 such that the first contact surface 36*a* and the second contact surface 37*a* are positioned in the same plane facing the pushing direction "F".

With this structure, the first contact surface 36*a* of the first contact portion 36 and the second contact surface 37*a* of the second contact portion 37 respectively contact and push the respective pad 2 of the card edge connector 3 toward the pushing direction "F".

The shape of the first kind of contact 35 of the second embodiment is explained in detail with reference to FIG. 17A.

From the bottom, the first kind of contact 35 is extended upward in the height direction "H" by the second terminal 39. Then, the first kind of contact 35 is bent in the opposite direction of the pushing direction "F" by the bending portion 40*d*, extended upward in the height direction "H" by the fixing portion 40*c*, and then inclined toward the pushing direction "F" and upward by the inclined portion 40*b* to the support portion 38.

The first contact portion 36 is formed to extend upward from the support portion 38 while being curved toward the pushing direction "F" to protrude toward the pushing direction "F" to form the first contact surface 36*a*, further extend upward while being inclined toward the opposite direction of the pushing direction "F", and then bent near the upper end to form the hook portion 36*b*. The second contact portion 37 has the same shape as the first contact portion 36. It means that the two contact portions 36 and 37 are provided to a single connecting portion 40. Further, for the first kind of contact portion 35, the first terminal (the first contact portion 36 and the second contact portion 37) and the second terminal 39 are positioned at the same side in the thickness direction "T".

Figure 18:
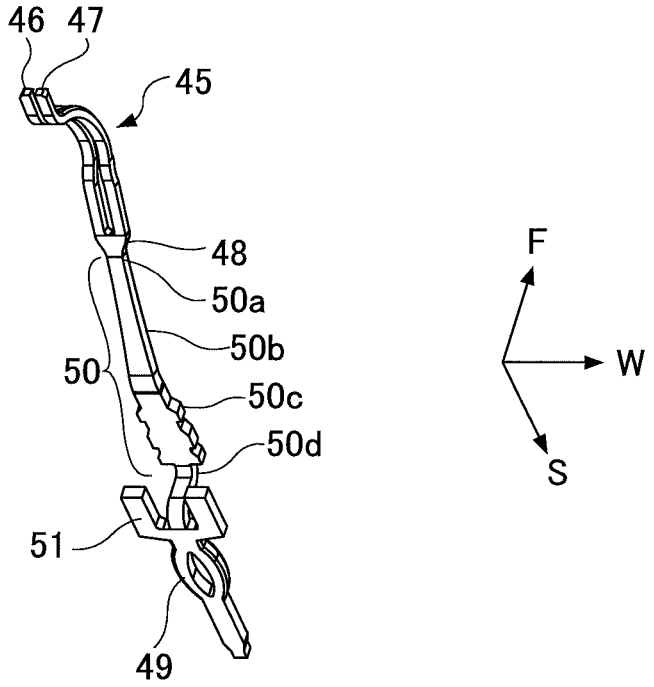
FIG. 18 is an enlarged perspective view of a second kind of contact of the second embodiment.
Figure 19C:
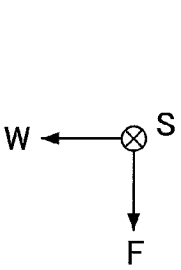
FIG. 19B is a plan view and FIG. 19C is a top view, of the second kind of contact of the second embodiment.
Figure 19C:
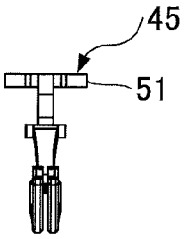
Figure 19B:
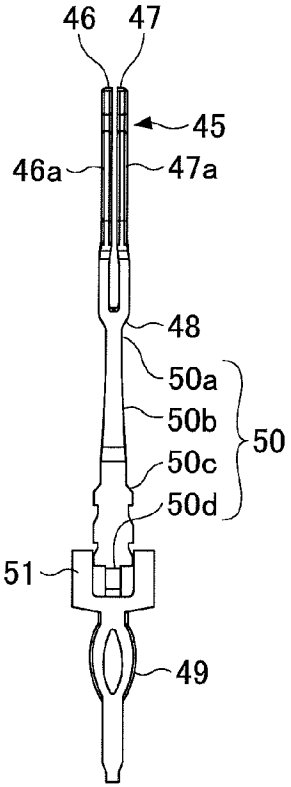
Figure 19B:
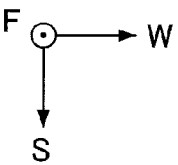
Figure 19A:
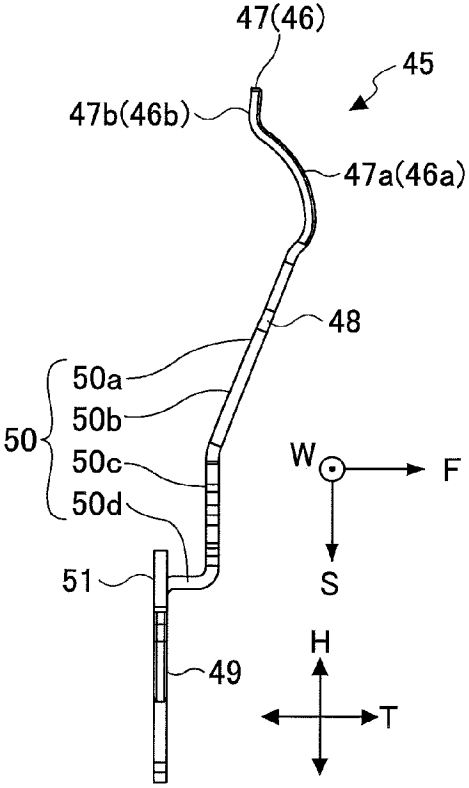
FIG. 19A is a side view.

FIG. 18 is an enlarged perspective view of a second kind of contact 45. FIG. 19A is a side view of the second kind of contact 45. FIG. 19B is a plan view of the second kind of contact 45. FIG. 19C is a top view of the second kind of contact 45.

The second kind of contact 45 includes a base portion composed of a support portion 48 and a connecting portion 50, a first terminal composed of a third contact portion 46 (first contact portion) and a fourth contact portion 47 (second contact portion), a second terminal 49 and a stopper 51.

The second kind of contact 45 has a similar structure as the first kind of contact 35, but the shifted direction of the second terminal 49 with respect to the fixing portion 50*c* is opposite to that of the first kind of contact 35. This means that for the second kind of contact 45, the first terminal (the third contact portion 46 and the fourth contact portion 47) and the second terminal 49 are positioned at different sides in the thickness direction "T".

The support portion 48 separately supports the third contact portion 46 and the fourth contact portion 47 from the different positions in the width direction "W". The support portion 48 has a triangle shape where a summit is positioned below to be connected to the connecting portion 50. The width of the support portion 48 becomes narrower the closer to the connecting portion 50.

In this embodiment, the third contact portion 46 and the fourth contact portion 47 of the second kind of contact 45 are extended from the support portion 48 in a parallel relationship with each other. The third contact portion 46 and the fourth contact portion 47 may be formed to be separated by a slit portion extending from the support portion 48. The second kind of contact 45 is aligned in the housing 34 such that the third contact portion 46 and the fourth contact portion 47 are aligned in the width direction "W".

The connecting portion 50 connects the support portion 48 and the second terminal 49. The connecting portion 50 includes an inclined portion 50*b*, a fixing portion 50*c* and a bending portion 50*d*.

The inclined portion 50*b* includes a neck portion 50*a* where the width in the width direction "W" is narrower than that of the support portion 48. Further, the width of the neck portion 50*a* is narrower than the other parts of the inclined portion 50*b*.

The inclined portion 50*b* is formed to have a width in the width direction "W" that becomes larger as closer to the second terminal 49. Further, the inclined portion 50*b* is formed to have a thickness in the thickness direction "T" that becomes larger the closer to the second terminal 49. Therefore, similar to the above described inclined portion 40*b* of the first kind of contact 35 with reference to FIG. 17A, the thickness near the bottom end of the inclined portion 50*b* is larger than the thickness at the neck portion 50*a*.

The fixing portion 50*c* is provided near the second terminal 49 and has protruding portions protruding in the width direction "W" to be fixed with the housing 34.

As shown in FIG. 19A, the bending portion 50*d* is formed to shift the second terminal 49 with respect to the fixing portion 50*c* in a direction opposite to the pushing direction "F". Compared with the first kind of contact 35 shown in FIG. 17A, the relative position of the second terminal 39 with respect to the fixing portion 40*c* and the relative position of the second terminal 49 with respect to the fixing portion 50*c* are opposite from each other.

The stopper 51 is formed to protrude upward in FIG. 18, FIG. 19A or FIG. 19B. In this embodiment, the stopper 51 has two protruding portions to have a shape like a "U".

As shown in FIG. 19A, the third contact portion 46 and the fourth contact portion 47 are provided with a third contact surface 46*a* and a hook portion 46*b*, and a fourth contact surface 47*a* and a hook portion 47*b*, respectively. The support portion 48 supports the third contact portion 46 and the fourth contact portion 47 such that the third contact surface 46*a* and the fourth contact surface 47*a* are positioned in the same plane facing the pushing direction "F".

With this structure, the third contact surface 46*a* of the third contact portion 46 and the fourth contact surface 47*a* of the fourth contact portion 47 respectively contact and push the respective pad 2 of the card edge connector 3 toward the pushing direction "F".

The shape of the second kind of contact 45 of the second embodiment is explained in detail with reference to FIG. 19A.

From the bottom, the second kind of contact 45 is extended upward in the height direction "H" by the second terminal 49. Then, the second kind of contact 45 is bent in the pushing direction "F" by the bending portion 50*d*, extended upward in the height direction "H" by the fixing portion 50*c*, and then inclined toward the pushing direction "F" and upward by the inclined portion 50*b* to the support portion 48.

The third contact portion 46 is formed to extend upward from the support portion 48 while being curved toward the pushing direction "F" to protrude toward the pushing direction "F" to form the third contact surface 46*a*, further extend upward while being inclined toward the opposite direction of the pushing direction "F", and then bent near the upper end to form the hook portion 46*b*. The fourth contact portion 47 has the same shape as the third contact portion 46. It means that the two contact portions 46 and 47 are provided to a single connecting portion 50. Further, for the second kind of contact portion 45, the first terminal (the third contact portion 46 and the fourth contact portion 47) and the second terminal 49 are positioned at different sides in the thickness direction "T" as described above.

The first kind of contact 35 and the second kind of contact 45 may be composed of a material having an electrical conductivity and elasticity such as a metal or the like and formed into the intended shape by pressing, bending or the like. The material may be a copper alloy or the like. Further, plating may be performed for the first contact surface 36*a*, the second contact surface 37*a*, the third contact surface 46*a* and the fourth contact surface 47*a*.

Figures 20A, 20B, 20C:
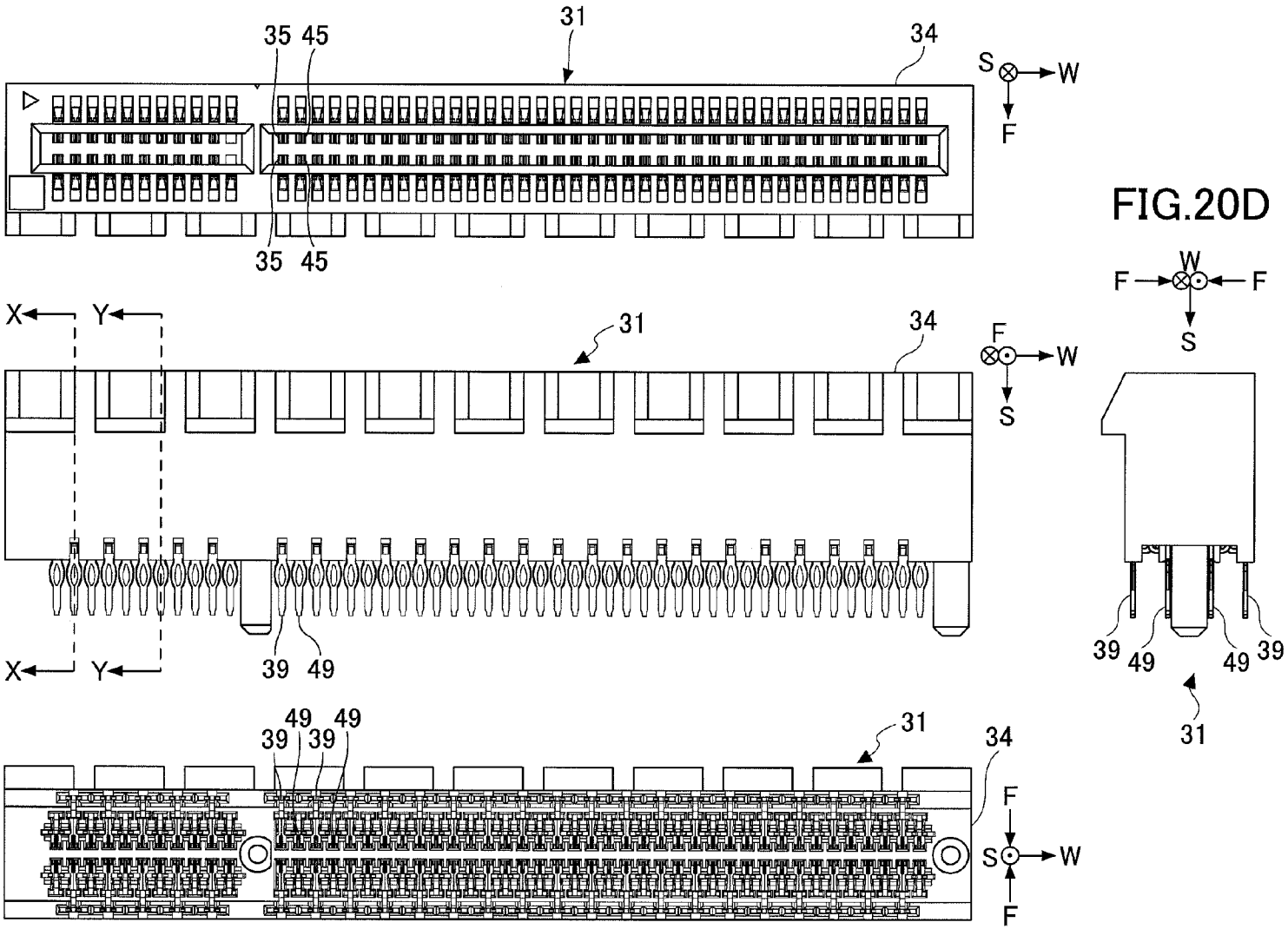
FIG. 20A is a top view.
FIG. 20B is a plan view.
FIG. 20C is a bottom view.

FIG. 20A is a top view, FIG. 20B is a plan view, FIG. 20C is a bottom view, and FIG. 20D is a side view, of the connector 31.

The first kind of contacts 35 and the second kind of contacts 45 are alternatively aligned, but the same kinds of the contacts are facing each other in the pushing direction "F", as shown in FIG. 20A.

Figure 21:
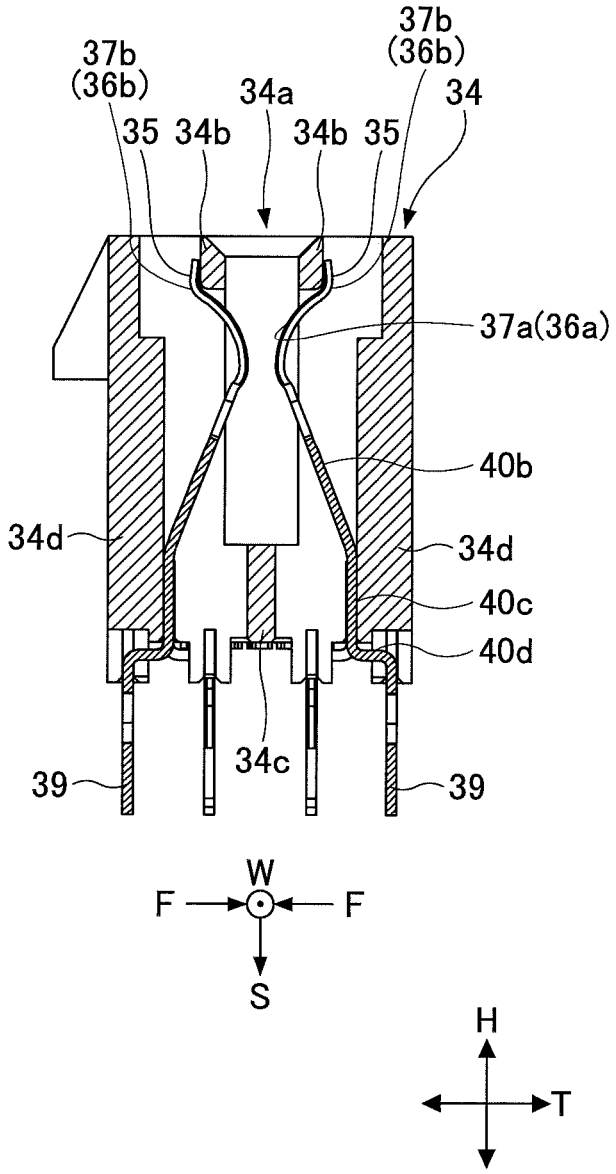
FIG. 21 is a cross-sectional view taken along an X-X line of FIG. 20B.

FIG. 21 is a cross-sectional view taken along an X-X line of FIG. 20B where the first kind of contacts 35 are shown.

The housing 34 is provided with an opening portion 34*a*, contact stoppers 34*b*, side walls 34*d* and a card edge stopper 34*c*.

The card edge connector 3 (although not shown in FIG. 21, see FIG. 1A) is detachably connected to the connector 31 by being inserted into the opening portion 34*a* of the housing 34 in the inserting direction "S". The card edge stopper 34*c* determines the position of the card edge connector 3.

A part of the second terminal 39 is inserted in a hole provided at the bottom portion of the side wall 34*d* of the housing 34 while the rest of the second terminal 39 is extended downward to be exposed from the housing 34.

The bending portion 40*d* is extended in the pushing direction "F" and the fixing portion 40*c* is extended upward along the side wall 34*d*.

Although not shown in the drawings, the side walls 34*d* of the housing 34 are provided with concave portions each having a shape corresponding to the protruding portions of the fixing portion 40*c* of each of the first kind of contacts 35 so that the first kind of contacts 35 can be fitted to the housing 34.

The inclined portion 40*b* is inclined upward and toward the pushing direction "F" so that the first contact surface 36*a* and the second contact surface 37*a* are positioned within the opening portion 34*a*.

The hook portions 36*b* and 37*b* are hooked by the contact stopper 34*b*.

Further, although not shown in the drawings, the side walls 34*d* of the housing 34 are further provided with stopper holes to receive the stopper 41 of the first kind of contact 35 or the stopper 51 of the second kind of contact 45. The stopper 41 of the first kind of contact 35 is inserted in the stopper holes of the side walls 34*d* of the housing 34. With this structure, the position of the second terminal 39 in the height direction "H" can be maintained even when an upward force is applied to the second terminal 39.

Figure 22:
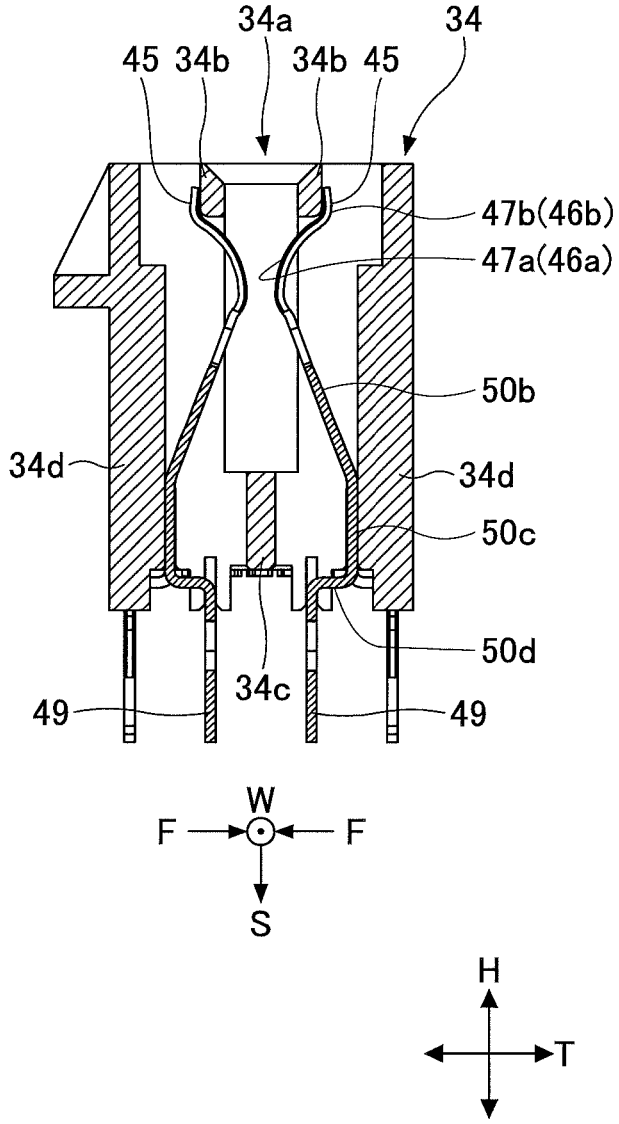
FIG. 22 is a cross-sectional view taken along a Y-Y line of FIG. 20B.

FIG. 22 is a cross-sectional view taken along a Y-Y line of FIG. 20B where the second kind of contacts 45 are shown.

Similar to the first kind of contact 35, a part of the second terminal 49 is inserted in a hole provided at the bottom portion of the side wall 34*d* of the housing 34 while the rest of the second terminal 49 is extended downward to be exposed from the housing 34.

The bending portion 50*d* is extended in the opposite direction of the pushing direction "F" and the fixing portion 50*c* is extended upward along the side wall 34*d*.

Although not shown in the drawings, the side walls 34*d* of the housing 34 are provided with concave portions each having a shape corresponding to the protruding portions of the fixing portion 50*c* of each of the second kind of contacts 45 so that the second kind of contacts 45 can be fitted to the housing 34.

The inclined portion 50*b* is inclined upward and toward the pushing direction "F" so that the third contact surface 46*a* and the fourth contact surface 47*a* are positioned within the opening portion 34*a*.

The hook portions 46*b* and 47*b* are hooked by the contact stopper 34*b*.

Although not shown in FIG. 22, similar to the stopper 41 of the first kind of contact 35, the stopper 51 of the second kind of contact 45 is inserted in the stopper holes of the side walls 34*d* of the housing 34. With this structure, the position of the second terminal 49 in the height direction "H" can be maintained even when an upward force is applied to the second terminal 49.

Similar to the connector 1 of the first embodiment, the second terminal 39 or the second terminal 49 of the connector 31 of the second embodiment can be supported by the base portion (the support portion 38 or 48 and the connecting portion 40 or 50) mechanically independent from the first terminal (the first contact portion 36 and the second contact portion 37, or the third contact portion 46 and the fourth contact portion 47).

In this embodiment, the connecting portion 40 of the first kind of contact 35 has an elastic function. Further, the second terminal 39 is connected to the connecting portion 40 via the bending portion 40*d*. With this structure, the force generated to the first contact portion 36 or the second contact portion 37 does not directly transmit to the second terminal 39 in the height direction "H". Therefore, the second terminal 39 is not influenced by the first contact portion 36 or the second contact portion 37.

It means that the base portion (the support portion 38 and the connecting portion 40) of the first kind of contact 35 is configured to support the first terminal (the first contact portion 36 and the second contact portion 37) and the second terminal 39 such that a "path" between the connecting ends of the first terminal at the support portion 38 and a connecting end of the second terminal 39 at the bending portion 40*d* includes a portion (bending portion 40*d*) extending in a direction perpendicular to the extending direction of the first contact portion 36 or the second contact portion 37. Therefore, the force generated to the first contact portion 36 or the second contact portion 37 can be reduced at such a portion of the "path".

Similarly, the connecting portion 50 of the second kind of contact 45 has an elastic function. Further, the second terminal 49 is connected to the connecting portion 50 via the bending portion 50*d*. With this structure, the force generated to the third contact portion 46 or the fourth contact portion 47 does not directly transmit to the second terminal 49 in the height direction "H". Therefore, the second terminal 49 is not influenced by the third contact portion 46 or the fourth contact portion 47.

It means that the base portion (the support portion 48 and the connecting portion 50) of the second kind of contact 45 is configured to support the first terminal (the third contact portion 46 and the fourth contact portion 47) and the second terminal 49 such that a "path" between the connecting ends of the first terminal at the support portion 48 and a connecting end of the second terminal 49 at the bending portion 50*d* includes a portion (bending portion 50*d*) extending in a direction perpendicular to the extending direction of the third contact portion 46 and the fourth contact portion 47. Therefore, the force generated to the third contact portion 46 or the fourth contact portion 47 can be reduced at such a portion of the "path".

The elastic function of the connecting portion 40 of the first kind of contact 35 or the connecting portion 50 of the second kind of contact 45 is explained. With the structure of the inclined portion 40*b* or 50*b* of the first kind of contact 35 or the second kind of contact 45 of this embodiment, where the width and the thickness of which is increased toward the second terminal 39 or 49, the elastic function can be further improved.

Figure 23:
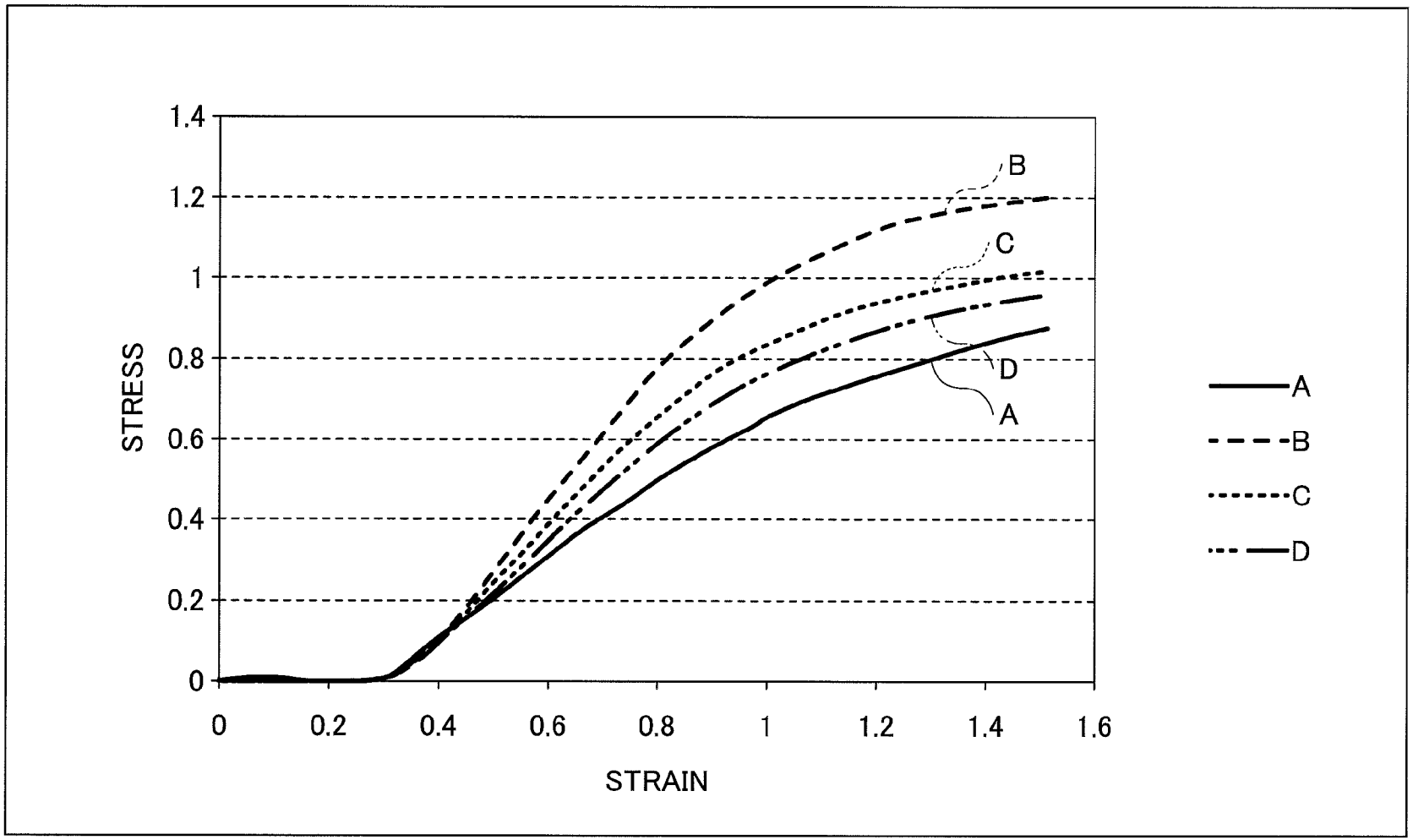
FIG. 23 is a graph showing stiffness curves where the lateral axis expresses strain and the vertical axis expresses stress.

FIG. 23 is a graph showing stiffness curves where the lateral axis expresses strain and the vertical axis expresses stress.

The curve shown by a curved line A is a stiffness curve of the first kind of contact 35 (or the second kind of contact 45) of the second embodiment.

The curve shown by a dotted curved line B is a stiffness curve of a structure similar to the first kind of contact 35 (or the second kind of contact 45) but an inclined portion having a constant width and a constant thickness is adopted instead of the inclined portion 40*b* or 50*b* described in the second embodiment. It means that the inclined portion of this example does not include a neck portion like the neck portion 40*a* or 50*a*.

The curve shown by a dotted curved line C is a stiffness curve of a structure similar to the first kind of contact 35 (or the second kind of contact 45) but an inclined portion having a constant width is adopted instead of the inclined portion 40*b* or 50*b* described in the second embodiment. It means that the inclined portion of this example does not include a neck portion like the neck portion 40*a* or 50*a*. However, the thickness of the inclined portion is increased toward the second terminal as the inclined portion 40*b* or 50*b*.

The curve shown by a dotted curved line D is a stiffness curve of a structure similar to the first kind of contact 35 (or the second kind of contact 45) but an inclined portion having a constant thickness is adopted instead of the inclined portion 40*b* or 50*b* described in the second embodiment. However, the width of the inclined portion is increased toward the second terminal as the inclined portion 40*b* or 50*b*. It means that the inclined portion of this example include a neck portion like the neck portion 40*a* or 50*a*.

As shown in FIG. 23, the linearity of the ratio of the stress with respect to the strain can be ensured within a larger range for the first kind of contact 35 or the second kind of contact 45 of the second embodiment (shown by the line A) can be wider compared with other cases. In other words, as for the first kind of contact 35 or the second kind of contact 45 of the second embodiment, a larger strain can be obtained with a smaller stress. Therefore, the electrical connection of the connector 31 of the second embodiment can be further ensured.

In addition, according to the first kind of contact 35 and the second kind of contact 45 of the second embodiment, each contact (35 or 45) includes two contact portions (the first contact portion 36 and the second contact portion 37 or the third contact portion 46 and the fourth contact portion 47) which are laterally disposed in the width direction "W". These two contact portions are separately supported by the support portion 38 or 48 at different positions in the width direction "W". Further, the support portion 38 or 48 is connected to the second terminal 39 or 49 via the connecting portion 40 or 50. With this structure, the force applied by the card edge connector 3 can be equally transmitted to the two contact portions (the first contact portion 36 and the second contact portion 37 or the third contact portion 46 and the fourth contact portion 47).

Further, the first contact portion 36 and the second contact portion 37 of the first kind of contact 35 or the third contact portion 46 and the fourth contact portion 47 of the second kind of contact 45 are configured to touch one of the pads 2 at different positions in the width direction "W". Therefore, even when dust or the like exists between one of the contact portions (36 and 37, or 46 and 47), the contact (35 or 45) can form the electrical connection between the pad 2 by the other of the contact portions (36 and 37, or 46 and 47).

With this, for the connector 31 of the second embodiment, the electrical connection between the pads 2 and the first kind of contact 35 and the second kind of contact 45 can be stabilized to improve the reliability.

Further, in this embodiment as well, the second terminals 39 of the first kind of contacts 35 and the second terminals 49 of the second kind of contacts 45 are aligned in a zigzag form in the width direction "W" and in the thickness direction "T", similar to that shown in FIG. 13 in the first embodiment. This alignment can be actualized by the bending portions 40*d* and 50*d*.

In addition, as the first kind of contact 35 and the second kind of contact 45 respectively include second terminals 39 and the second terminals 49 to be fitted in the through holes TH of the substrate 30 (see FIG. 13), the connector 31 can be electrically connected to the substrate 30 by a press-fit, without using solder.

The embodiments relate to a connector that can be applied for a home, an office or an industrial electronic device as they are capable of improving the reliability in an electrical connection and being connected to a substrate by press-fit.

According to the embodiment, as the support portion separately supports the first contact portion and the second contact portion, the first contact portion and the second contact portion are mechanically independent from each other even when the connecting target (card edge connector 3) is contacted and pushed toward the first contact portion and the second contact portion. With this, the reliance in the electrical connection can be improved.

According to the embodiments, a connector capable of improving the reliability in an electrical connection and being connected to a substrate by press-fit is provided.

The present invention is not limited to the specifically disclosed embodiments, and variations and modifications may be made without departing from the scope of the present invention.

The present application is based on Japanese Priority Application No. 2011-083049 filed on Apr. 4, 2011, the entire contents of which are hereby incorporated herein by reference.

What is claimed is:

1. A connector to be electrically connected to a connecting target including plural electrical objects to be contacted and to a substrate provided with plural concave portions, comprising:

a housing; and plural contacts which are held by the housing and respectively correspond to the plural objects of the connecting target and the plural concave portions of the substrate, each of the contacts including a first terminal configured to extend in a first direction to be connected with the object of the connecting target, and include a first contact portion provided with a first contact surface to contact the object, a second contact portion provided with a second contact surface to contact the object, a second terminal configured to extend in a second direction opposite to the first direction to be fitted in the concave portion of the substrate, and a base portion configured to be provided with a support portion that separately supports the first contact portion and the second contact portion of the first terminal at different positions such that the first contact surface and the second contact surface are positioned in the same plane, and separately support the second terminal from the first terminal.

2. The connector according to claim 1, wherein the support portion is configured to support the first terminal and the second terminal and includes a path provided between an end of the first terminal connected to the support portion and an end of the second terminal connected to the support portion that extends in a direction perpendicular to the first direction.

3. The connector according to claim 1, wherein the support portion of the base portion supports the first contact portion and the second contact portion at different positions in a direction perpendicular to the first direction.

4. The connector according to claim 1, wherein the first terminal and the second terminal of each of the contacts are positioned to shift in a direction perpendicular to the first direction.

5. The connector according to claim 1, wherein the support portion is configured to support the first contact portion and the second contact portion such that the first contact surface of the first contact portion and the second contact surface of the second contact portion are positioned on a same line but at different positions in the first direction.

6. The connector according to claim 1, wherein the contacts include a first kind of contact and a second kind of contact, which are alternatively aligned in an alignment direction perpendicular to the first direction, such that the support portion of the first kind of contact and the support portion of the second kind of contact are positioned to extend in a third direction which is perpendicular to the alignment direction and the first direction, in each of the plural first kind of contacts, the first terminal and the second terminal are positioned at the same side of the base portion in the third direction, and in each of the plural second kind of contacts, the first terminal and the second terminal are positioned at the different sides of the base portion in the third direction.

7. The connector according to claim 1, wherein the base portion of the contact is provided with a slit portion extended from its one end so that the slit portion is positioned between the first terminal and the second terminal.

8. The connector according to claim 7, wherein the support portion of the contact is provided such that the support portion is shifted in the alignment direction such that the first terminal is shifted in the alignment direction with respect to the second terminal.

9. The connector according to claim 1, wherein the contact further includes a fixing portion configured to extend in the first direction to be fitted with the housing.

10. The connector according to claim 1, wherein the base portion is provided with a connecting portion that connects the support portion and the second terminal, the connecting portion includes an inclined portion extending in the first direction while being inclined toward a fourth direction perpendicular to the first direction, to which the first contact surface of the first contact portion and the second contact surface of the second contact portion face, and the inclined portion is formed to have a thickness in the fourth direction that becomes larger the closer to the second terminal.

11. The connector according to claim 1, wherein the plural contacts are aligned in an alignment direction perpendicular to the first direction, the base portion is provided with a connecting portion that connects the support portion and the second terminal, the connecting portion includes an inclined portion extending in the first direction while being inclined toward a fourth direction perpendicular to the first direction, to which the first contact surface of the first contact portion and the second contact surface of the second contact portion face, and the inclined portion is formed to have a width in the alignment direction that becomes larger the closer to the second terminal.

12. The connector according to claim 1, wherein the plural contacts are aligned in an alignment direction perpendicular to the first direction, the base portion is provided with a connecting portion that connects the support portion and the second terminal, the connecting portion includes an inclined portion extending in the first direction while being inclined toward a fourth direction perpendicular to the first direction, to which the first contact surface of the first contact portion and the second contact surface of the second contact portion face, and the inclined portion is formed to have a width in the alignment direction that becomes larger the closer to the second terminal and a thickness in the fourth direction that becomes larger the closer to the second terminal.

13. The connector according to claim 1, wherein the plural contacts are composed of plural first kind of contacts and plural second kind of contacts, which are alternatively aligned in an alignment direction perpendicular to the first direction, the base portion of each of the first kind of contacts and the second kind of contacts is provided with a connecting portion that connects the support portion and the second terminal, the connecting portion includes an inclined portion extending in the first direction while being inclined toward a fourth direction perpendicular to the first direction, to which the first contact surface of the first contact portion and the second contact surface of the second contact portion face, in each of the first kind of contacts, the connecting portion further includes a bending portion that is extended from the second terminal to extend in an opposite direction of the fourth direction such that the second terminal is positioned at the same side with the first terminal in the fourth direction, and in each of the second kind of contacts, the connecting portion further includes a bending portion that is extended from the second terminal to extend in the fourth direction such that the second terminal is positioned at the different side from the first terminal in the fourth direction.

14. The connector according to claim 1, wherein the contacts include a first kind of contact and a second kind of contact, which are alternatively aligned in an alignment direction perpendicular to the first direction, in each of the first kind of contacts, the base portion is formed to support the second terminal to be positioned at the same side with the first terminal in a third direction which is perpendicular to the alignment direction, and in each of the second kind of contacts, the base portion is formed to support the second terminal to be positioned at the different side from the first terminal in the third direction.

15. A connector to be electrically connected to a connecting target including electrical terminals and to a substrate, the connector comprising:

a housing; and contacts which are held by the housing and correspond to the electrical terminals of the connecting target, respectively, each of the contacts including a support portion, a first contact that is supported by the support portion and configured to extend in a first direction, provided with a first contact surface configured to contact with the electrical terminal of the connecting target, a second contact that is supported by the support portion and configured to extend in the first direction, provided with a second contact surface configured to contact with the electrical terminal of the connecting target, and a terminal to be connected to the substrate, that is supported by the support portion and is configured to extend in a second direction opposite to the first direction, wherein the first contact and the second contact are supported by the support portion at the different positions such that the first contact surface and the second contact surface are positioned in the same plane.

* * * * *